US009060606B1

(12) United States Patent
Steinbok

(10) Patent No.: US 9,060,606 B1
(45) Date of Patent: Jun. 23, 2015

(54) TABLE DISPLAY, BENCH AND SHIPPING PLATFORM CONVERTIBLE APPARATUS AND METHOD OF USE

(71) Applicant: Harry Steinbok, Boca Raton, FL (US)

(72) Inventor: Harry Steinbok, Boca Raton, FL (US)

( * ) Notice: Subject to any disclaimer, the term of this patent is extended or adjusted under 35 U.S.C. 154(b) by 0 days.

(21) Appl. No.: 14/102,002

(22) Filed: Dec. 10, 2013

Related U.S. Application Data

(63) Continuation-in-part of application No. 13/271,324, filed on Oct. 12, 2011, now Pat. No. 8,601,954, which is a continuation-in-part of application No. 12/983,316, filed on Jan. 2, 2011, now Pat. No. 8,459,189.

(60) Provisional application No. 61/291,897, filed on Jan. 2, 2010.

(51) Int. Cl.
*A47B 85/04* (2006.01)
*A47B 85/06* (2006.01)
*B65D 19/38* (2006.01)

(52) U.S. Cl.
CPC ..... *A47B 85/06* (2013.01); *B65D 19/38* (2013.01)

(58) Field of Classification Search
CPC ..... A47B 85/04; A47B 85/06; A47B 3/06; A47B 2003/008; B65D 19/0055; B65D 19/0053; B65D 19/38
USPC ..... 108/11, 18, 14, 53.3, 53.5, 53.1, 901, 108/57.25, 57.28, 51.11, 91; 248/166, 168, 248/169, 171, 164, 431, 432, 188, 188.1, 248/188.6; 297/124, 119, 440.16, 440.14
See application file for complete search history.

(56) References Cited

U.S. PATENT DOCUMENTS

| | | | | |
|---|---|---|---|---|
| 957,439 | A | 5/1910 | McGuigan | |
| 1,252,766 | A | 1/1918 | Anderson | |
| 1,553,036 | A | 9/1925 | Foss | |
| 1,564,189 | A | 12/1925 | Anderson | |
| 1,976,031 | A | 10/1934 | Lowenberg | |
| 2,068,591 | A | 1/1937 | Bennett | |
| 2,466,204 | A * | 4/1949 | Brown | 297/115 |
| 2,937,062 | A | 5/1960 | Kruse | |
| 3,063,667 | A | 11/1962 | Doty, Jr. et al. | |
| 3,236,003 | A * | 2/1966 | Flood, Jr. | 446/110 |

(Continued)

FOREIGN PATENT DOCUMENTS

GB 2272203 5/1994

*Primary Examiner* — Janet M Wilkens
(74) *Attorney, Agent, or Firm* — Allen D. Hertz, P.A.; Allen D. Hertz

(57) ABSTRACT

A pair of platform assemblies, each platform assembly having a platform and a pair of supporting members extending downward from an underside of the platform. The elements of the platform assemblies can be assembled into a shipping configuration, a table configuration, and a bench configuration. In a shipping configuration, the platform assemblies are abutted and joined along a mating edge. The plurality of legs are inserted into leg receiving channels of each platform and the pair of platforms are joined together to form the shipping configuration. In a table configuration, the legs are assembled to a platform in a generally perpendicular relation. In a bench configuration, one platform is oriented horizontally with legs assembled thereto extending downward therefrom, and a second platform is oriented vertically and assembled to an upper surface of the horizontally oriented platform. The bench and table configurations can be covered for aesthetic improvements.

20 Claims, 26 Drawing Sheets

(56) References Cited

U.S. PATENT DOCUMENTS

| | | | | |
|---|---|---|---|---|
| 3,256,839 | A | 6/1966 | Peterson et al. | |
| 3,601,067 | A | 8/1971 | Olsen | |
| 3,672,723 | A * | 6/1972 | Decursu et al. | 297/440.24 |
| 3,677,200 | A | 7/1972 | Coccagna et al. | |
| 3,804,032 | A | 4/1974 | Baucom | |
| 3,807,581 | A | 4/1974 | Nichols | |
| 3,941,291 | A | 3/1976 | Hayworth | |
| 5,097,957 | A | 3/1992 | Adams et al. | |
| 6,769,367 | B2 | 8/2004 | Schutz | |
| 8,714,652 | B2 * | 5/2014 | Whidden et al. | 297/440.15 |
| 8,764,114 | B1 * | 7/2014 | Frank et al. | 297/440.16 |
| 8,783,778 | B2 * | 7/2014 | Nelson et al. | 297/440.1 |
| 2003/0136308 | A1 | 7/2003 | Lung | |
| 2007/0227406 | A1 | 10/2007 | Korbonski | |
| 2008/0223262 | A1 | 9/2008 | Chew et al. | |
| 2010/0175596 | A1 | 7/2010 | Scheetz | |
| 2010/0257673 | A1 | 10/2010 | Linares | |

* cited by examiner

TABLE DISPLAY, BENCH AND SHIPPING PLATFORM CONVERTIBLE APPARATUS AND METHOD OF USE

CROSS-REFERENCE TO RELATED APPLICATION

This application is a Continuation-In-Part Patent Application claiming the benefit of U.S. Non-Provisional patent application Ser. No. 13/271,324, filed on Oct. 12, 2011 (scheduled to issue as U.S. Pat. No. 8,601,954 on Dec. 10, 2013), which is a Continuation-In-Part Patent Application claiming the benefit of U.S. Non-Provisional patent application Ser. No. 12/983,316, filed on Jan. 2, 2011 (now issued as U.S. Pat. No. 8,459,189 on Jun. 11, 2013), which claims the benefit of U.S. Provisional Patent Application Ser. No. 61/291,897, filed on Jan. 2, 2010, which is incorporated herein in its entirety.

FIELD OF THE INVENTION

The present invention relates to a display and shipping apparatus, and more particularly, a shipping apparatus that converts to a display table, the apparatus being used for transporting objects to trade shows and displaying objects at the trade shows and similar events.

BACKGROUND OF THE INVENTION

The invention pertains to a shipping apparatus that converts to a presentation table for transporting to and displaying objects at trade shows and similar events. Conversely, the table assembly (provided by a pair of tables) is converted to a shipping apparatus.

Marketing planning must include a means for transporting samples and other display materials to and from promotional expositions.

An exposition, commonly referred to as a trade show or trade fair, is an exhibition organized so that companies in a specific industry can showcase and demonstrate their latest products, service, study activities of rivals, and examine recent trends and opportunities. Some expositions are open to the public (classified as "Public"), while others are limited to company representatives (members of the trade) and members of the press (classified as "Trade only"). The expositions are held on a continuing basis in virtually all markets, normally attracting companies from around the globe. To understand the size of these expositions, there are currently over 2500 expositions held annually in the United States.

Expositions often involve a considerable marketing investment by the participating companies. Costs include space rental, design and construction of trade show displays, transportation of the displays and materials, telecommunications and networking, travel, accommodations, and promotional literature and items to give to attendees. In addition, costs are incurred at the show for services such as electrical, booth cleaning, Internet services, and drayage (also known as material handling).

Several shipping pallets are known to include a series of legs that attach in a vertical orientation to the pallet platform. The legs must be packaged with the display materials for transport to and from the expositions. The leg attachment interface is generally considered as acceptable, but not solid. Further, the leg interface is not self-stabilizing.

When shipping material to an exposition or other event, the shipping material is normally stored in a location outside of the display arena. When collapsing and preparing to return the display, the personnel need to wait until the shipping materials are returned from the stored location.

Accordingly, there remains a need in the art for a device that provides both display capabilities and shipping capabilities to aid in preparation, presentation, and closure of an exposition.

SUMMARY OF THE INVENTION

The present invention overcomes the deficiencies of the known art and the problems that remain unsolved by providing a method and respective apparatus for shipping and display of items to and from exhibitions.

In accordance with one embodiment of the present invention, the invention consists of a display table and shipping platform apparatus comprising:

a first platform assembly;

a second platform assembly;

each platform assembly comprising a platform and a pair of leg receiving frame members disposed upon an underside of each platform, said pair of leg receiving frame members being parallel and symmetrically arranged to an underside of each platform;

at least one leg receiving aperture provided through a sidewall of the leg receiving frame members; and at least two leg subassemblies, each leg subassembly comprising a pair of legs being pivotally attached proximate a central portion of the legs, wherein the leg receiving frame members are formed for receiving and storing the leg subassemblies therein.

In a second aspect, the leg receiving frame members of the first platform align with the leg receiving frame members of the second platform when the first and second platforms are abutted, wherein the inserted legs provide support across a joint formed between both the first and second platforms when the display table and shipping platform apparatus is assembled in a shipping configuration.

Yet another aspect, the platform assemblies further comprise at least one platform-to-platform attachment interface for securing two adjacent platform assemblies together.

While another aspect, the platform-to-platform attachment interface further comprising a slot having a pin aperture disposed at each end of the slot and a rectangular "U" shaped securing pin that is inserted through the two pin apertures.

With yet another aspect, a wobble brace is provided, being assembled between each pair of leg subassemblies. The wobble brace is preferably assembled between the pivot and the attachment shoulder of the leg subassemblies. The wobble brace is inserted into a receiving aperture, said receiving aperture being respectively located.

Yet another aspect, a wobble brace storage slot is provided within at least one of the legs for receiving and storing one or more wobble brace during shipping.

Regarding another aspect, the legs of the leg subassemblies are rotated into an "X" configuration and the shoulders are inserted through the leg receiving apertures of each of the bracket assemblies.

In yet another aspect, each bracket assembly further comprises an interior leg receiving aperture and a respective exterior leg-receiving aperture.

Another aspect includes a shoulder stop tab located on an exterior flange of each of the bracket assemblies for limiting motion of the shoulder of each leg.

In another aspect, a handle aperture is provided through the platform. The handle aperture is preferably centrally positioned proximate a longer edge of the platform. It is understood that any handle design can be integrated with the platform assembly.

While another aspect allows the conversion between a table configuration and a shipping configuration (and vice versa) to be accomplished without the need to any tools.

With another aspect is a reduction or elimination of a need for storage of the shipping materials.

In accordance with a second embodiment of the present invention, the invention consists of a display table and shipping platform apparatus comprising:

a first platform assembly;

a second platform assembly;

each platform assembly comprising a platform and a pair of leg receiving frame sections provided upon an underside of each platform, said pair of leg receiving frame members being parallel and symmetrically arranged to an underside of each platform;

at least one leg receiving aperture provided through a distal wall of the leg receiving frame sections; and at least four leg subassemblies, each leg subassembly comprising an assembly pin extending from an end of a leg body, wherein the leg receiving frame sections are formed for receiving and storing the leg subassemblies therein in a manner whereby the leg subassemblies provide support to the first platform assembly and second platform assembly in a shipping configuration.

In a second aspect, the assembly pin extends parallel to a longitudinal axis of the leg body.

Yet another aspect, the system comprises four legs, and each leg receiving frame section of each platform assembly is of a size and shape to snugly receive two legs.

While another aspect, the system comprises eight legs, and each leg receiving frame section of each platform assembly is of a size and shape to snugly receive four legs.

With yet another aspect, each leg receiving frame section further comprises a first leg receiving aperture through a distal wall and a second leg receiving aperture integrated into a lower portion of a platform section. The first leg receiving aperture and the second leg receiving aperture are spatially arranged.

Whereas in another aspect, the display table and shipping platform apparatus comprises four (4) leg receiving apertures integrated into each of the two platform assemblies and eight (8) total leg subassemblies.

In yet another aspect, the display table and shipping platform apparatus comprises two (2) leg receiving apertures integrated into each of the two platform assemblies and four (4) total leg subassemblies.

Yet another aspect, each platform section further comprises a plurality of platform reinforcing features to increase the rigidity of the platform. In one embodiment, the platform reinforcing features are cylindrically shaped cavities extending into an underside of the platform.

With yet another aspect, the leg receiving apertures further comprises a leg shoulder receptacle for receiving a leg assembly pin transition. The interface between the leg shoulder receptacle and the leg assembly pin transition retains the leg assembly in a desired rotation.

In another aspect, the platform assembly further comprises a central support element, the central support element comprising a central support end, wherein the central support end is coplanar with the shipping platform support surface.

In accordance with a third embodiment of the present invention, the invention consists of a display table and shipping platform apparatus comprising:

a first platform assembly;

a second platform assembly;

each platform assembly comprising:

a platform section having a platform upper surface, a platform lower surface, a mating edge, a distal edge located opposite the mating edge, a pair of lateral edges extending perpendicular between the mating edge and the distal edge, and a thickness, a pair of platform support sections, each platform support section extending downward from an underside of each platform proximate the respective lateral edge, and a plurality of leg receiving apertures, each leg receiving aperture extending into each of said platform sections from said mating edge;

at least one leg receiving aperture provided through the mating edge of the platform section; and at least four leg subassemblies, each leg subassembly comprising an assembly interface segment extending from an end of a leg body segment, wherein the at least one leg receiving aperture are formed for receiving and storing the leg subassemblies therein in a manner whereby the leg subassemblies provide support to the first platform assembly and second platform assembly in a shipping configuration.

In a second aspect, at least one leg receiving aperture further comprises at least four leg receiving apertures; one leg receiving aperture for receiving each of the at least four leg subassemblies.

Yet another aspect, each of the at least one leg receiving aperture being sized and shaped to receive a plurality of leg subassemblies.

While another aspect, each leg assembly is formed comprising a continuous cylindrically shaped body segment and assembly interface segment.

With yet another aspect, each platform further comprises a plurality of channel defining slots. The slots reference the locations of the leg storage channels.

Whereas in another aspect, the leg storage channels are arranged parallel to a lateral edge of the platform In yet another aspect, each platform further comprises a pair of central support elements extending downward from an underside of the platform. Each central support element comprises a central support end, wherein the central support end is coplanar with a shipping platform support surface of each platform support section. The central support elements are spaced apart to receive the at least four leg subassemblies.

Yet another aspect, each platform support sections comprises an interior facing surface, wherein a distance between opposing interior facing surfaces of the pair of platform support sections is proximate a length of the leg assembly.

With yet another aspect, the at least four leg subassemblies are placed within an area defined between the opposing interior facing surfaces of the pair of platform support sections and opposing faces of the pair of central support elements.

In another aspect, the at least one leg receiving aperture is formed having a depth that is approximate one-half the length of any of the at least four leg subassemblies.

In yet another aspect, a pair of platform assemblies can be assembled together forming a bench configuration.

While in another aspect, the legs are inserted into apertures formed through the base or horizontal platform assembly and into the leg storage channels of a back or vertical platform assembly.

With another aspect, one or more platform assemblies can be covered with a material cover. The cover can be shaped to cover one or more platform assemblies.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
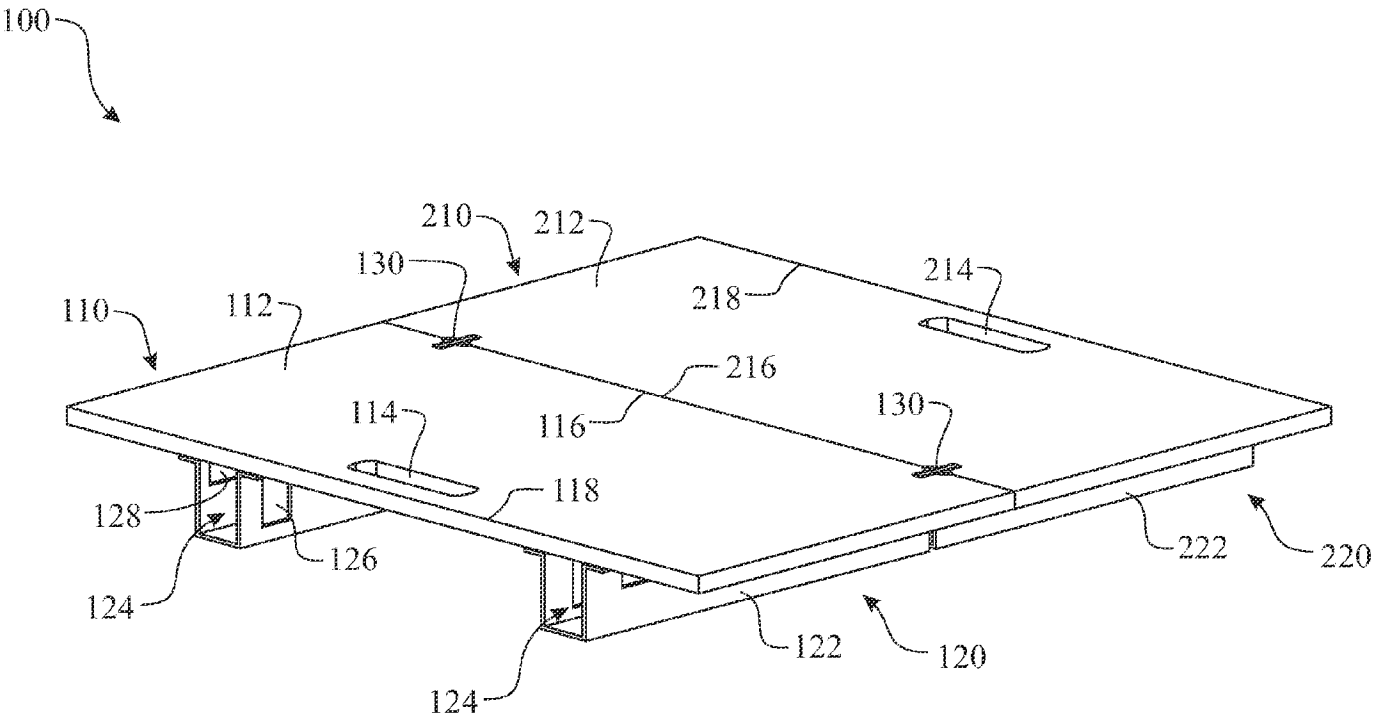
FIG. 1 presents an isometric view of a display table and shipping platform apparatus shown in a shipping configuration.
Figure 2:
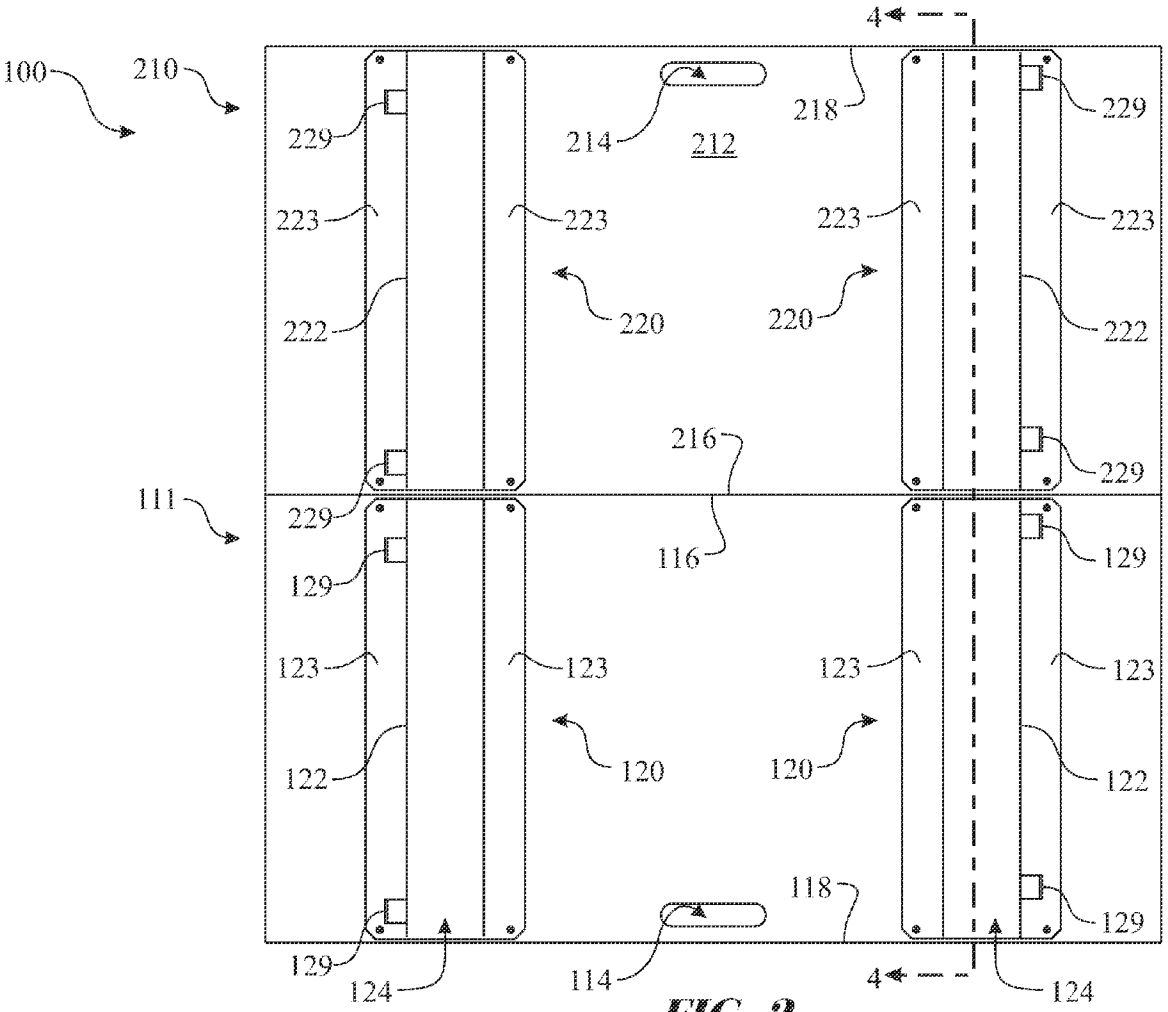
FIG. 2 presents a bottom side planar view of the display table and shipping platform apparatus of FIG. 1, shown in a shipping configuration.

For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

An exemplary display table and shipping platform apparatus 100 is illustrated in a transport or shipping configuration as presented in FIGS. 1 through 4. The display table and shipping platform apparatus 100 comprises a first platform assembly 110 and a second platform assembly 210 being assembled via a plurality of platform-to-platform attachment interfaces 130. Each platform assembly 110, 210 is fabricated having a pair of bracket assemblies 120 assembled to an underside of a platform 112 in a parallel arrangement. The bracket assemblies 120 are spaced to allow forks of a standard pallet jack to be inserted between facing sidewalls of the bracket assembly 120.

Figure 3:
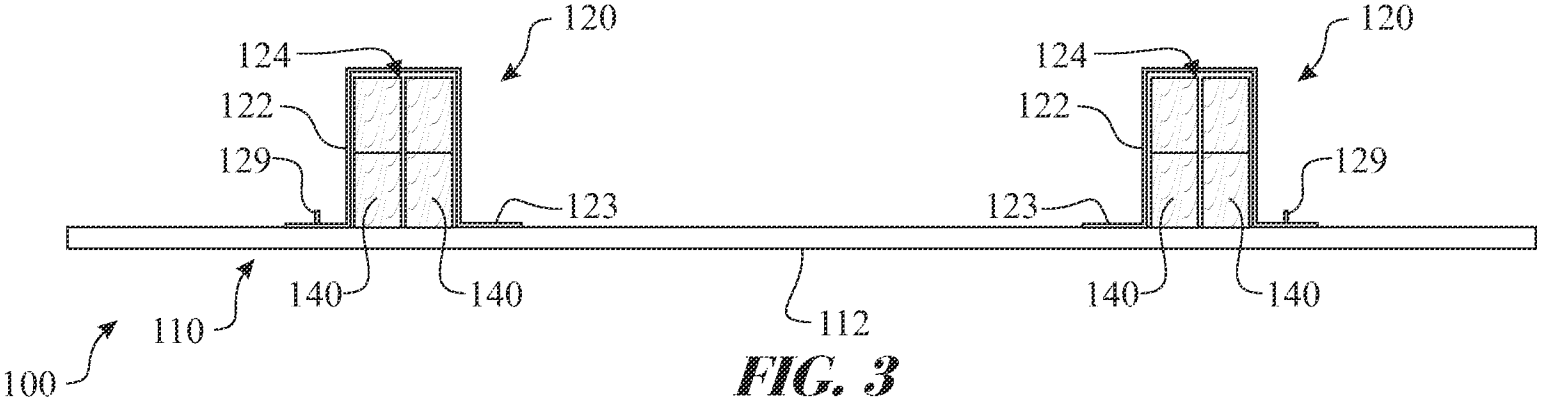
FIG. 3 presents a side elevation view of the display table and shipping platform apparatus of FIG. 1, shown in a shipping configuration.
Figure 4:
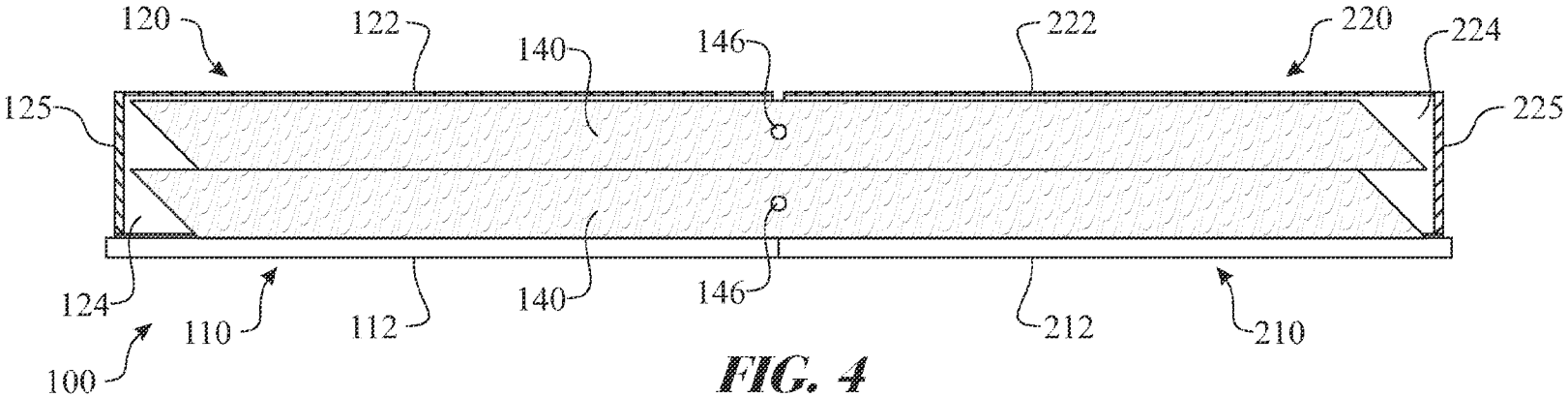
FIG. 4 presents a sectioned end elevation of the display table and shipping platform apparatus taken along section 4-4 of FIG. 2.
Figure 5:
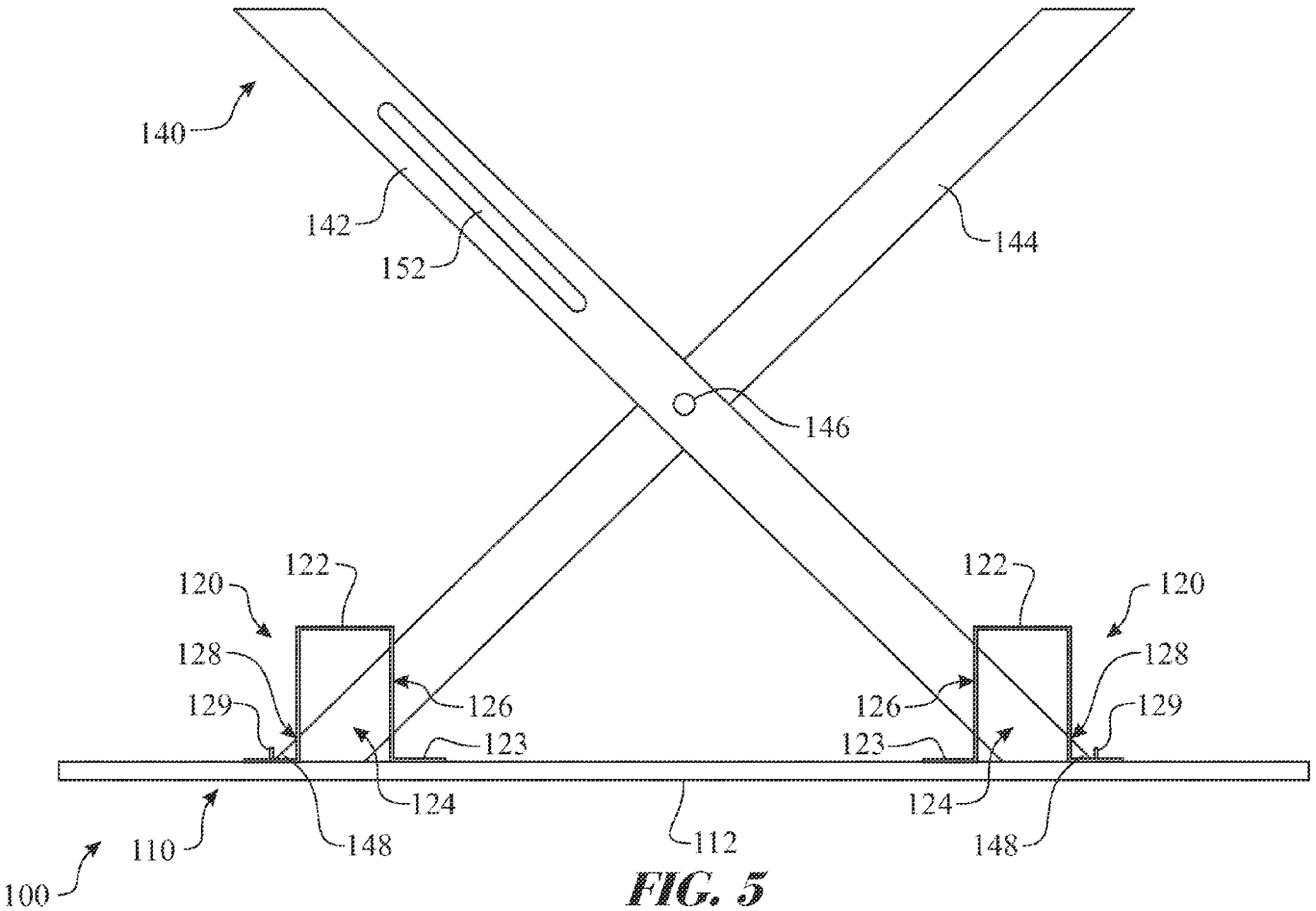
FIG. 5 presents a side elevation view of the display table and shipping platform apparatus of FIG. 1, shown in a display table configuration.

The bracket assembly 120 is fabricated having a leg receiving frame member 122 forming a leg storage channel 124. The leg storage channel 124 is preferably of a shape and size to receive a pair of leg subassemblies 140 as illustrated in FIGS. 3 and 4. The preferred shape of the leg receiving frame member 122 comprises a box section having a pair of bracket mounting flanges 123 extending outward from a mounting edge of the box section. The bracket mounting flange 123 is utilized for attaching the bracket assembly 120 to the platform assembly 110. The bracket assembly 120 is attached to the platform assembly 110 via any form of mechanical fastener, including screws, bolts, adhesive, and the like. A pair of interior leg receiving aperture 126 and exterior leg receiving aperture 128 are formed through the sidewalls of the leg receiving frame member 122 for receiving the leg subassembly 140. Details of the apertures 126, 128 and assembly will be described at a later point in the disclosure. A leg storage end cap 125 can be provided at one end of the bracket assembly 120. The leg storage end cap 125 ensures the leg subassemblies 140 remains within the leg storage channel 124 of the bracket assembly 120. The leg storage end cap 125 can be solid, partially covering the open end of the leg storage channel 124, affixed, removable, and the like.

The leg subassemblies 140 are fabricated having a first leg 142, and a second leg 144 being pivotally assembled via a leg attachment pivot member 146. The ends of the legs are preferably shaped having the shoulder end 148 cut at an angle for insertion into the leg receiving apertures 126, 128. A foot end can be shaped in any desirable shape for adequately supporting the display table and shipping platform apparatus 100 when in a table configuration.

A platform handle 114 can be provided through the platform 112 offering the user a location from gripping the platform 112, securing strapping, and the like. It is understood that any handle design can be integrated with the platform assembly.

A pair of pinned attachment interfaces 132 secures the first platform assembly 110 to the second platform assembly 210. The second platform assembly 210 is assembled comprising the same components of the first platform assembly 110. Like features of second platform assembly 210 and first platform assembly 110 are numbered the same except preceded by the numeral '2'. The first platform assembly 110 and second platform assembly 210 are mating components, wherein each being preferably the same shape, size, and configuration. The platform assemblies 110, 210 are designed positioning each bracket assembly 120 equidistant from, and parallel to, a centerline extending perpendicularly from a center point of a mating (longer) edge of the platform 112. This configuration allows the user to position the mating edge 116 of the first platform assembly 110 butting against a mating edge 216 of the second platform assembly 210. A distal edge 118 is parallel to and located opposite the mating edge 116. Similarly, a distal edge 218 is parallel to and located opposite the mating edge 216. The first platform bracket assembly 120 aligns with the second platform bracket assembly 220 forming a single storage channel for the leg subassemblies 140 as best illustrated in FIG. 4. Besides storage, the leg subassemblies 140 create a beam, providing structural support to the display table and shipping platform apparatus 100.

In the preferred embodiment, the platform 112 is fabricated of wood, such as ¾" or 1" plywood. The edges would be finished to remove sharp edges, minimize splintering, and avoid any injury to others. Features such as the platform handle 114 and platform-to-platform attachment interface 130 can be machined into the platform 112 via any machining process. The platform 112 can alternately be fabricated of a moldable material such as recycled plastics via a molding process. Features such as the platform handle 114 and platform-to-platform attachment interface 130 would be formed therein during the molding process. The bracket assembly 120 is preferably fabricated of a single formed metal sheet. The apertures 126, 128 would be stamped through the material prior to shaping. Alternately, the material can be extruded and subsequently machined. The leg storage end cap 125 can be formed from the single metal sheet and secured into positioned via a welding process, a mechanical fastener, and the like. Alternately, the leg storage end cap 125 can be removably attached to the leg receiving frame member 122 via any reasonable mechanical interface. The leg subassemblies 140 are fabricated having a pair of wooden legs 142, 144 being pivotally assembled via a pivot fastener 146. The pivot fastener 146 can be fabricated of metal, plastic, wood, and the like. The bracket assemblies 120 are assembled to the underside of the platform 112 via a series of mechanical fasteners, such as wood screws, bolts, adhesive, and the like.

Figure 6:
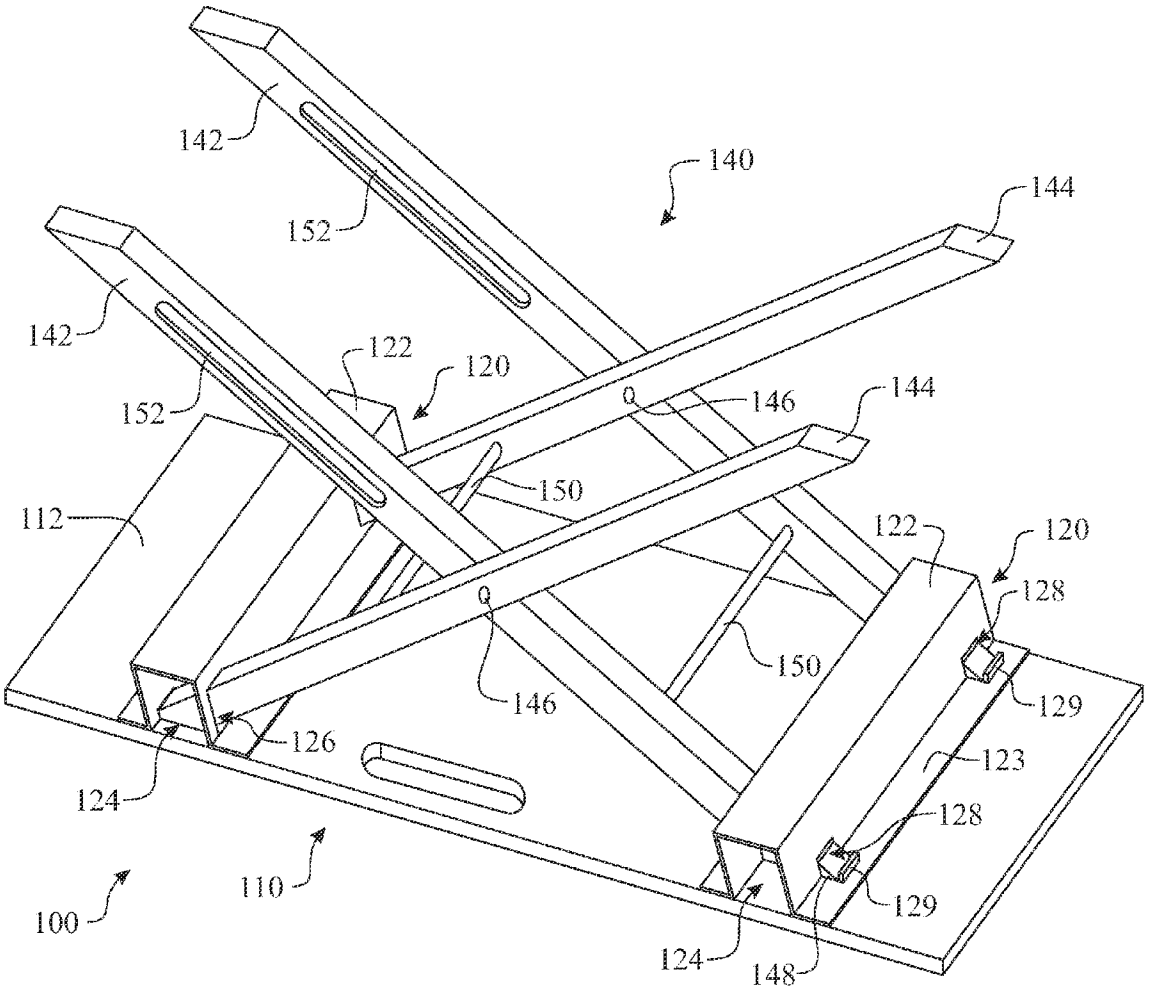
FIG. 6 presents an isometric underside view of the display table and shipping platform apparatus of FIG. 1, shown in a display table configuration.
Figure 7:
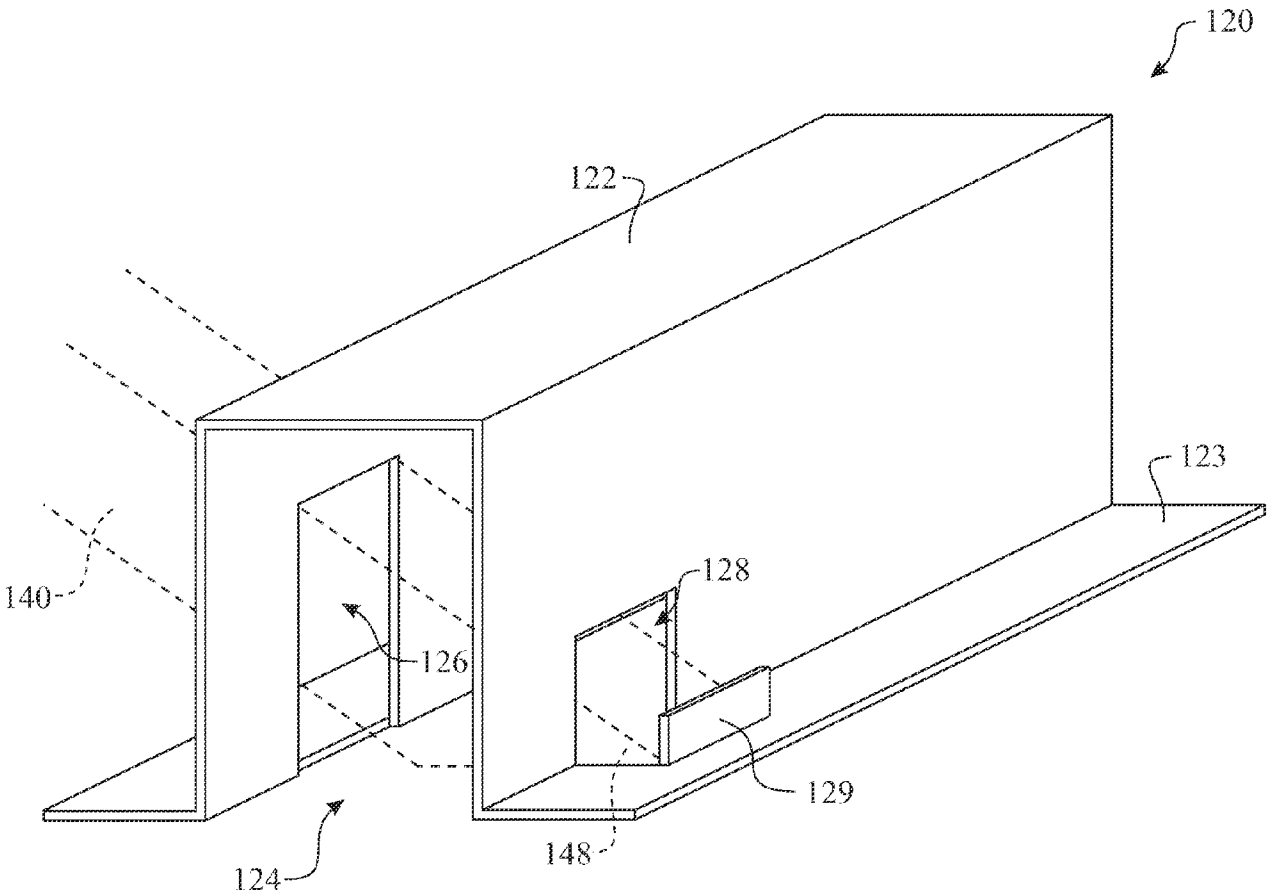
FIG. 7 presents an isometric view detailing a leg to platform attachment interface.
Figure 8:
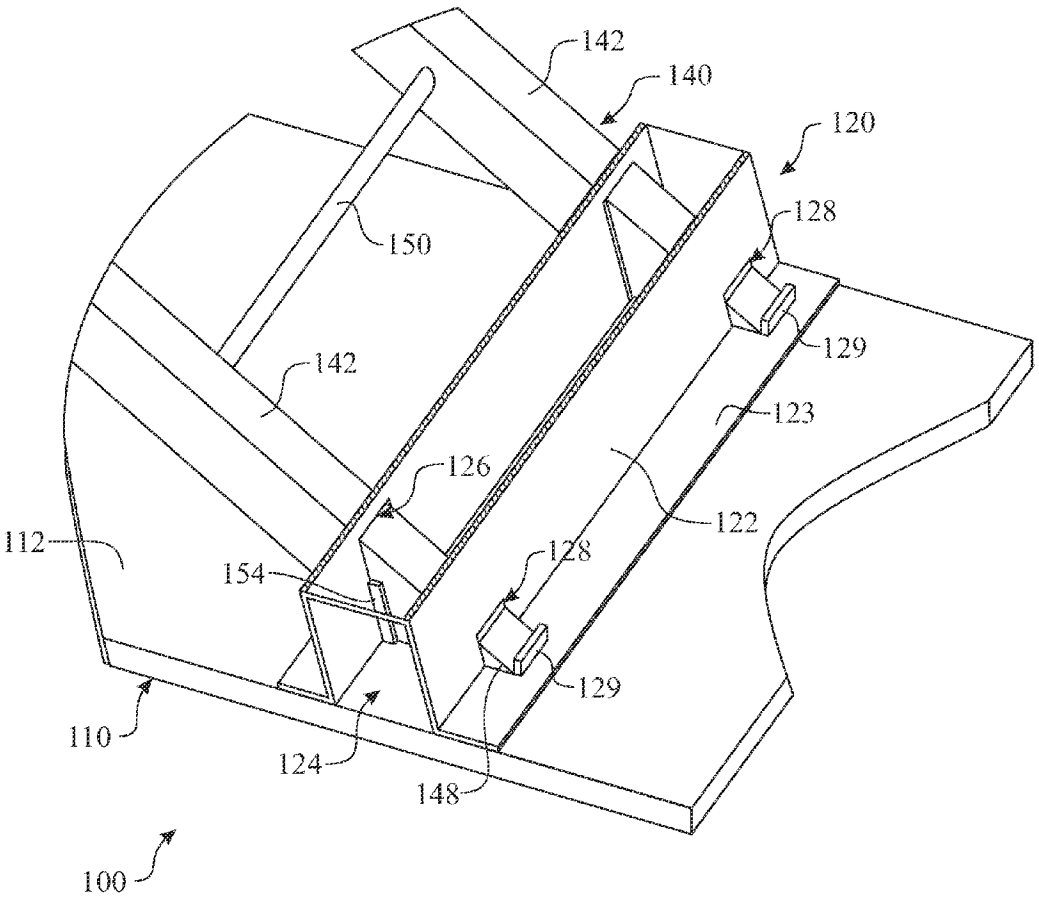
FIG. 8 presents an isometric view detailing a leg to platform attachment interface, further illustrating a leg locking tab.
Figure 9:
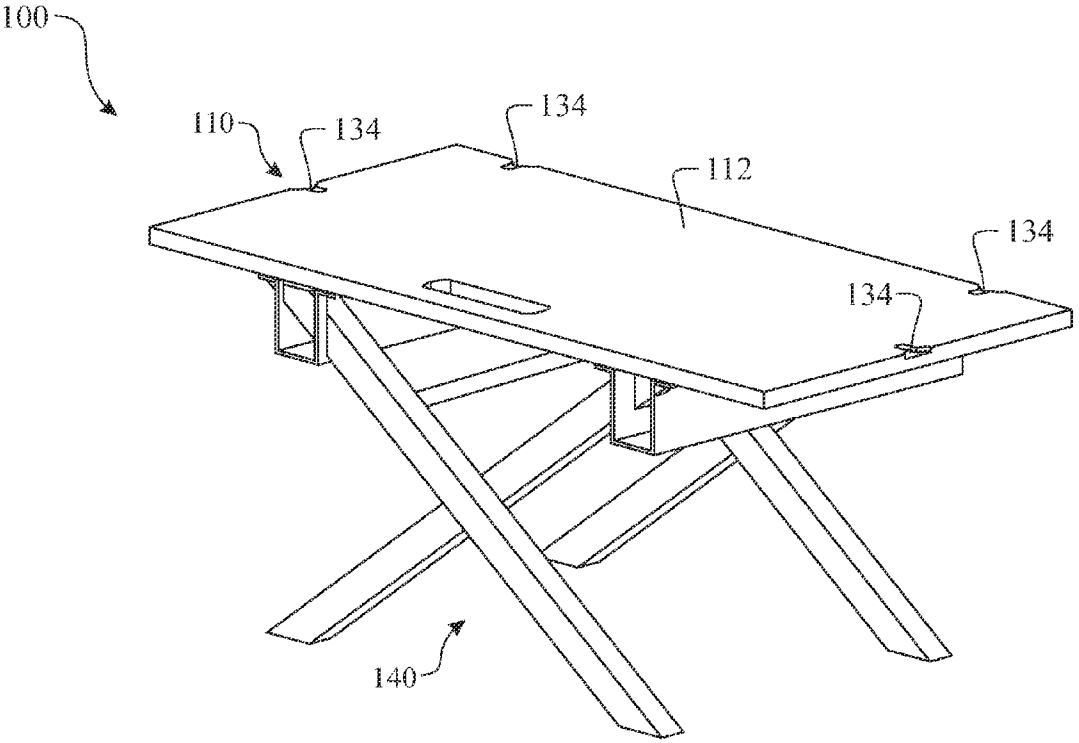
FIG. 9 presents an isometric topside view of the display table and shipping platform apparatus of FIG. 1, shown in a display table configuration.

The exemplary display table and shipping platform apparatus 100 is illustrated in a table or display configuration as presented in FIGS. 5 through 9. A worker disengages the platform-to-platform attachment interface 130 allowing the platform assembly 110 to separate from the platform assembly 210. The separation provides access to the leg subassemblies 140 stored within the leg storage channels 124, 224. The worker removes the leg subassemblies 140 from the leg storage channels 124, 224. The worker removes the wobble braces 150 from the wobble brace storage slots 152, setting them temporarily aside. The first leg 142 and second leg 144 are then pivoted into an "X" shape. Each shoulder 148 is inserted a respective set of leg receiving apertures 126, 128, as detailed in FIG. 7. The shoulder 148 is positioned abutting a leg stop tab 129. The shoulder 148 can also be wedged into the exterior leg receiving aperture 128, providing a frictional interface between the surface of the shoulder 148 contacting the underside of the platform 112 and the opposite edge of the exterior leg receiving aperture 128. A leg locking tab 154 can optionally be attached to at least one leg 142, 144 proximate the respective shoulder 148. The thickness of the combined leg 142, 144 and leg locking tab 154 equals a width of the interior leg receiving aperture 126, allowing for the worker to slip the leg locking tab 154 through the interior leg receiving aperture 126. The wobble brace 150 is then installed spanning between the respective pair of legs 142, 144 as best illustrated in FIG. 6. The desired wobble brace 150 are fabricated from dowels. Each wobble brace 150 is inserted into a pair of holes drilled into the legs 142, 144. A tapered lead-in may be formed about one of the pair of holes to aid in the insertion of the wobble brace 150. The wobble brace 150 separates the legs 142, 144. The wobble brace 150 also engages the leg locking tab 154 against an interior surface of the leg receiving frame member 122, locking the shoulder 148 in position. The worker then inverts the table version of the display table and shipping platform apparatus 100, as illustrated in FIG. 9. It is understood that a slot or notch may be provided in each leg 142, 144 as an alternate to the leg locking tab 154.

The "X" configuration of the leg subassemblies 140 provides an additional benefit. As weight is added to the table, the legs are rotated outward. The rotation increases the wedge of the shoulder 148 into the exterior leg receiving aperture 128, strengthening the interface.

Figure 10:
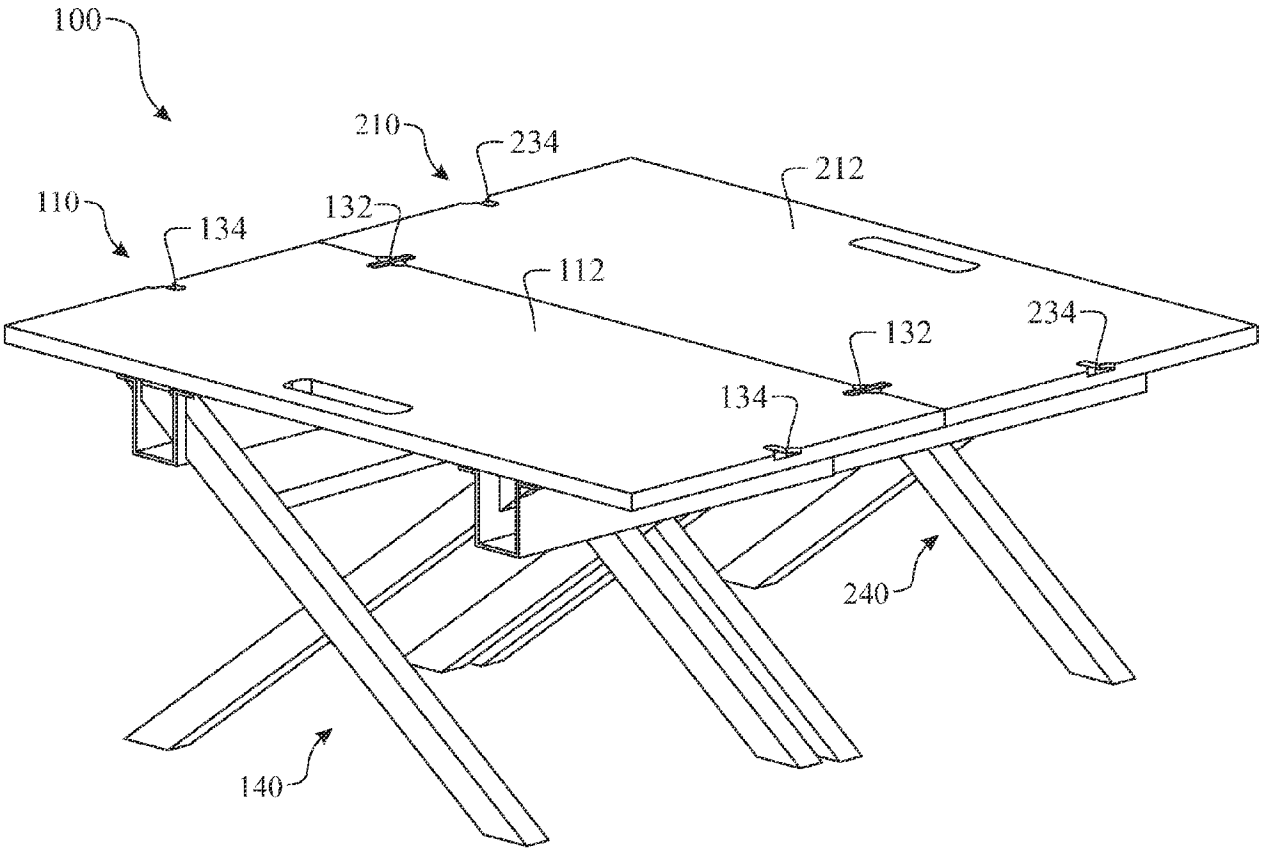
FIG. 10 presents an isometric view of a pair of tables assembled together mating the longer edges of the platforms to extend the depth of the display surface.
Figure 11:
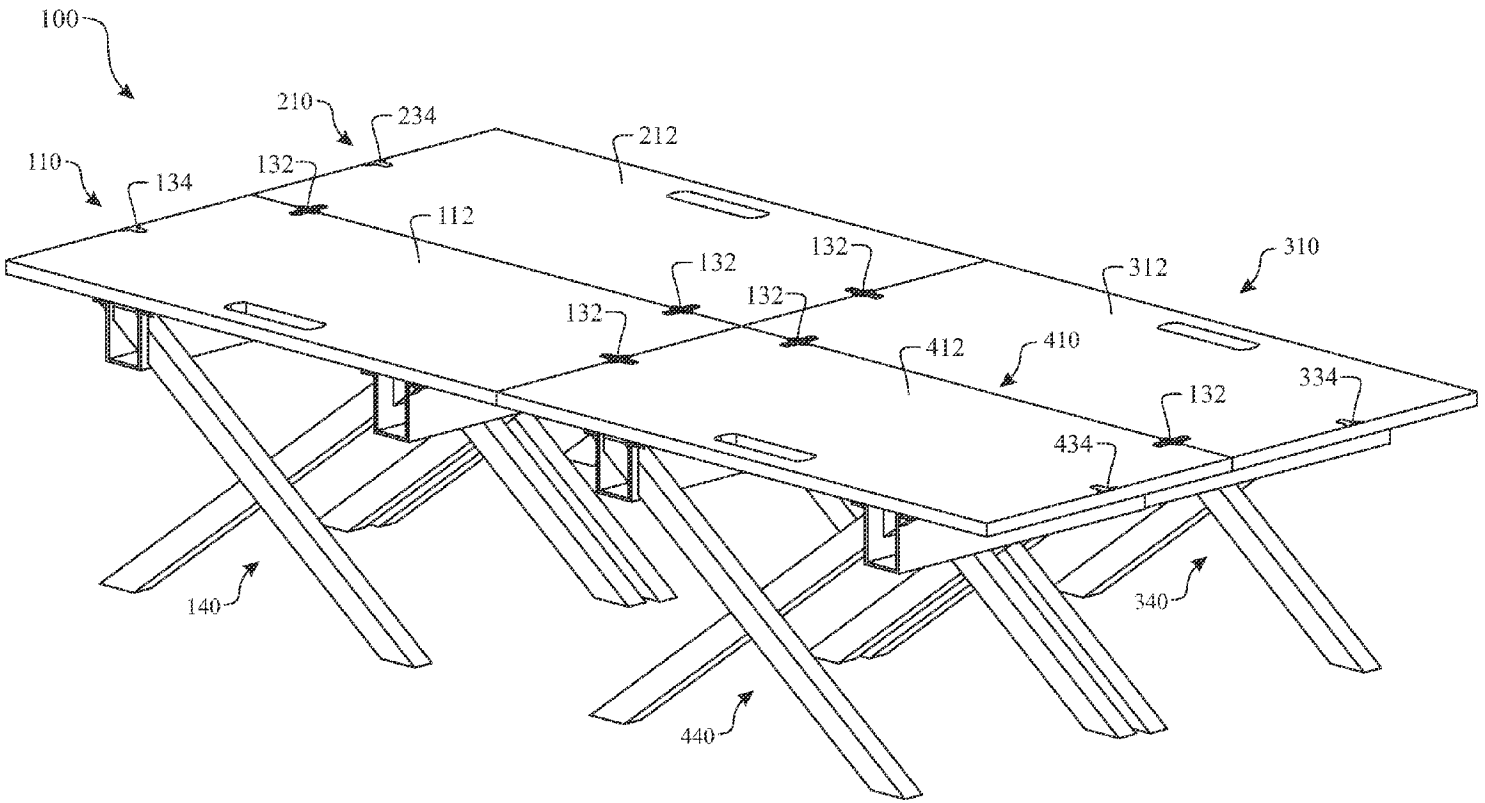
FIG. 11 presents an isometric view of a plurality of tables assembled together mating the longer edges of the platforms to extend the depth of the display surface and mating the shorter edges of the platforms to extend the length of the display surface.
Figure 13:
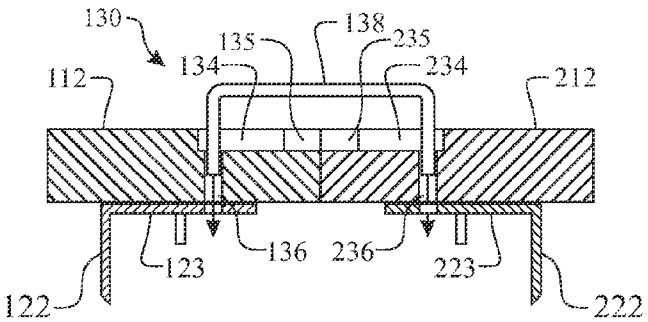
FIG. 13 presents sectioned end elevation of the exemplary platform-to-platform attachment interface taken along section 13-13 of FIG. 12.
Figure 12:
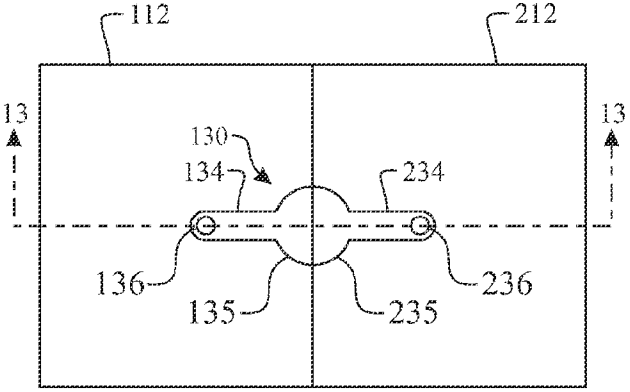
FIG. 12 presents a planar top view of an exemplary platform-to-platform attachment interface.

To enlarge the display surface, the worker can attached a plurality of tables 100 together, as demonstrated in the exemplary illustrations shown in FIGS. 10 through 13. The series of platform assemblies 110, 210, 310, 410 are the same assemblies, being numbered accordingly for clarity in defining the assembly process. The third platform assembly 310 is assembled comprising the same components of the other platform assemblies 110, 210. Like features of third platform assembly 310 and other platform assemblies 110, 210 are numbered the same except preceded by the numeral '3'. The fourth platform assembly 410 is assembled comprising the same components of the other platform assemblies 110, 210, 310. Like features of fourth platform assembly 410 and platform assemblies 110, 210, 310 are numbered the same except preceded by the numeral '4'. The depth of the display table can be increased by joining the first platform assembly 110 with the second platform assembly 210 along the longer edge via a series of pinned attachment interfaces 132 as illustrated in FIG. 10. The length of the table can be increased by joining the first platform assembly 110 with the fourth platform assembly 410 (similarly joining a second platform assembly 210 with a third platform assembly 310) along the shorter edge via a series of pinned attachment interfaces 132 as understood from the illustration of FIG. 11. The exemplary configuration allows the worker to create a wider and longer table by joining a plurality of tables 110, 210, 310, 410 together as illustrated in FIG. 11.

The exemplary joining method utilizes a first attachment interface recession half 134 mated with a second attachment interface recession half 234. A first pin aperture 136 is disposed through the platform 112, and preferably aligned and continuing through an outer bracket mounting flange 123. Similarly a second pin aperture 236 is disposed through the platform 212, and preferably aligned and continuing through an outer bracket mounting flange 223. A securing pin 138 is formed in a square "U" shape with each end being inserted through each pin aperture 136, 236, forming the pinned attachment interface 132, securing the platform 112 with the platform 212. A finger clearance is formed by each of the first removal finger clearance half 135 and second removal finger clearance half 235, giving the worker the ability to access, grip, and remove the securing pin 138 from the pinned attachment interface 132.

Figure 14:
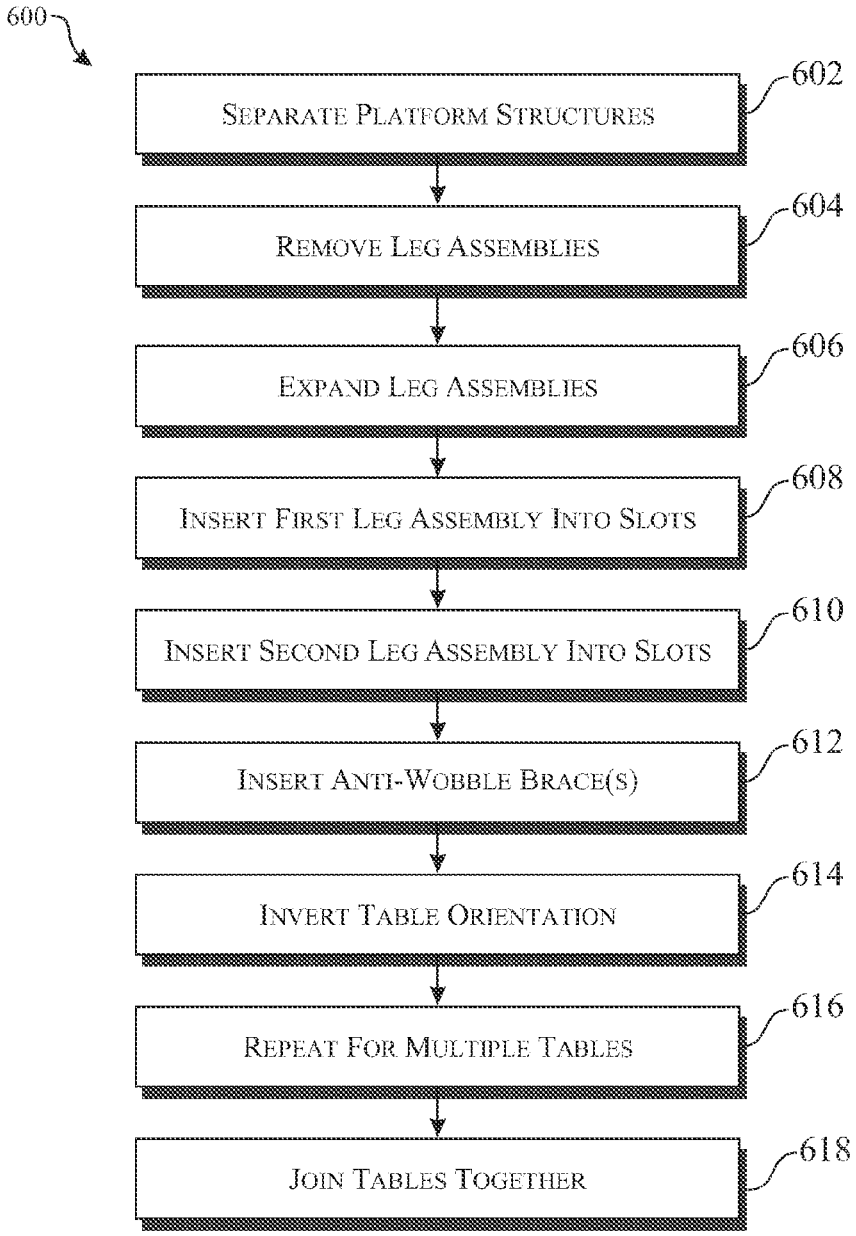
FIG. 14 presents a flow diagram detailing a platform to table conversion process.

A table conversion flow diagram 600 is illustrated in FIG. 14. A worker initiates the process by separating 602 the two platform assemblies 112, 212. The leg subassemblies 140 are removed from the leg storage channel 124 in accordance with a leg removal step 604. The first leg 142 and second leg 144 are pivoted into an "X" configuration via a leg expansion step 606. The shoulder 148 is inserted into the leg receiving apertures 126, 128 of the bracket assembly 120 following a first leg subassembly insertion step 608. The leg insertion step is repeated 610, assembly a second leg subassembly to the platform assembly 110. A wobble brace 150 is assembled between the pair of legs as directed in an anti-wobble brace insertion step 612. The worker checks to ensure the leg subassembly 140 are properly secured to the platform assembly 110, and upon verification, the assembly is inverted 614 into a table configuration. The process is repeated 616, assembling additional table assemblies. The plurality of table assemblies are joined 618 as desired to increase the width, the length, or both.

One of the benefits of the display table and shipping platform apparatus 100 is that the apparatus 100 resolves the issue for storing and retrieving the shipping materials. The display table and shipping platform apparatus 100 remains at the display without taking up valuable space. It is common to have union personnel aiding marking people at expositions. This practice limits the accessibility to stored materials during and after the exposition to only a select few individuals. Due to the limited number of people allowed to access and retrieve the stored materials, the time required to retrieve the materials is significantly higher. The shipping display table assembly 100 easily converts between a shipping configuration and a display configuration without any tooling.

Figure 20:
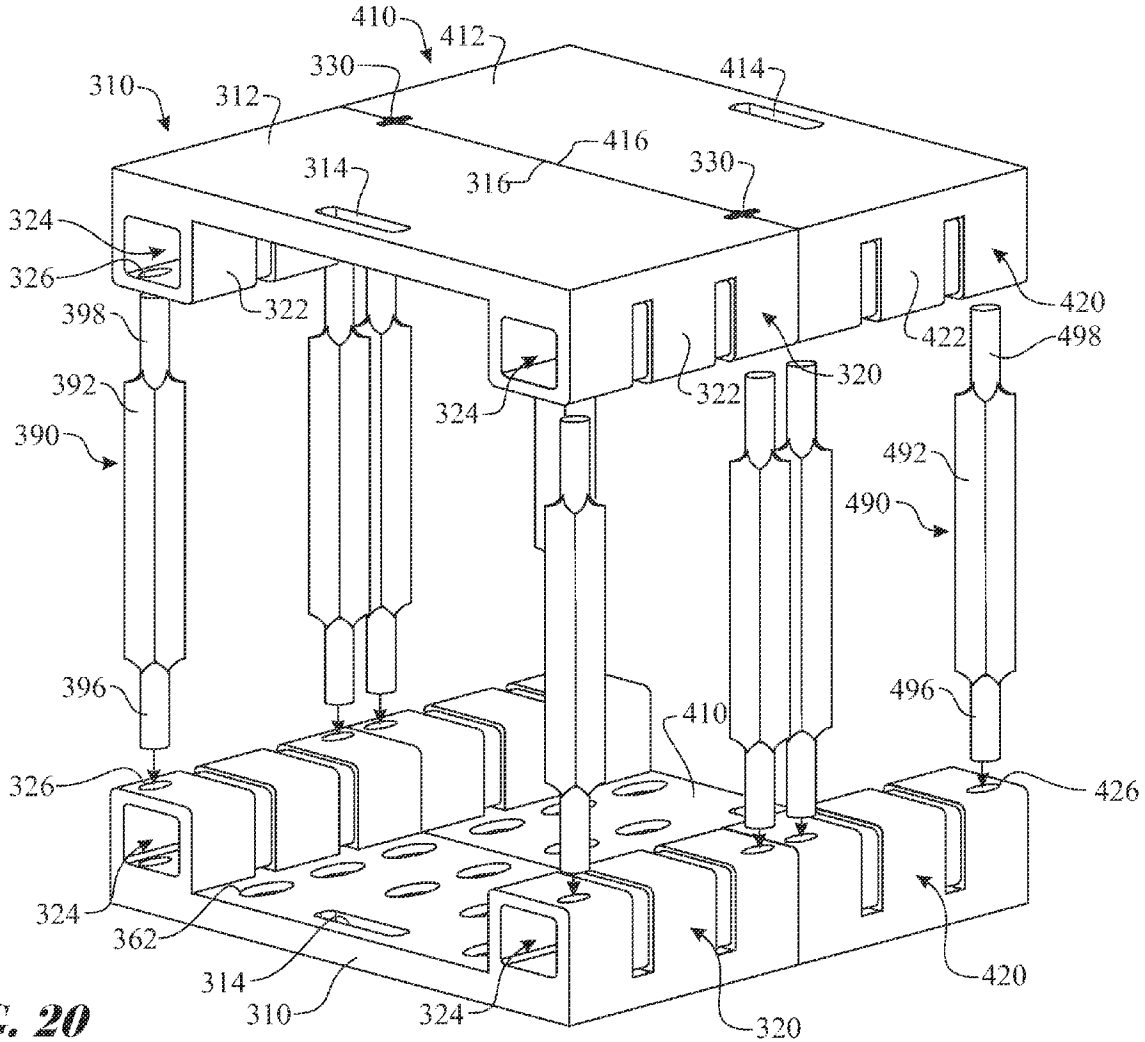
FIG. 20 presents an isometric exploded assembly view of the display table and shipping platform apparatus originally introduced in FIG. 15, shown in a coffee table configuration.
Figure 21:
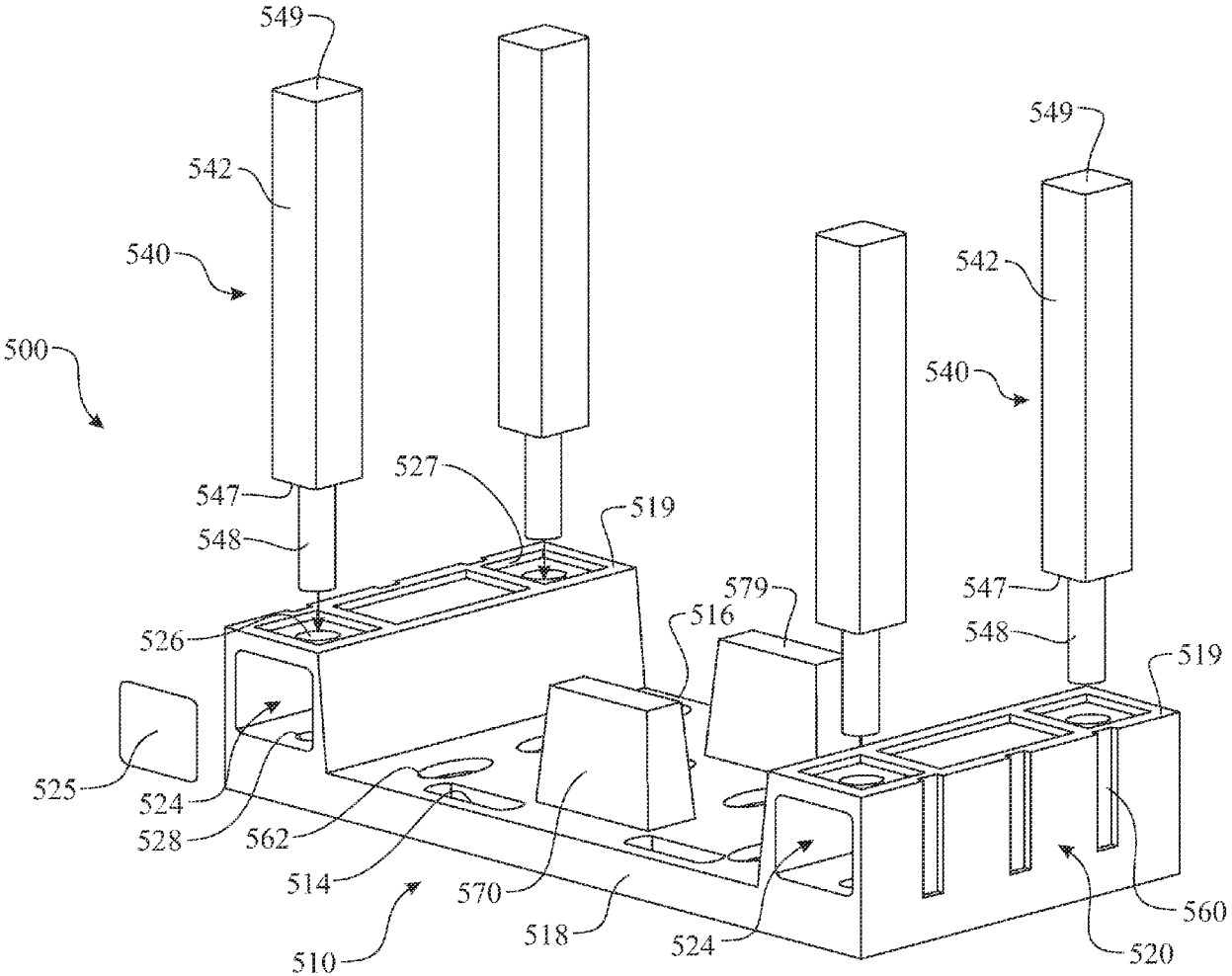
FIG. 21 presents an isometric exploded assembly view of an enhanced version of the display table and shipping platform apparatus.

An alternate exemplary embodiment introduced as a display table and shipping platform apparatus 300, 400, which is illustrated in FIGS. 15 through 20, with enhancements introduced in a display table and shipping platform apparatus 500 illustrated in FIG. 21. The display table and shipping platform apparatus 300 and display table and shipping platform apparatus 400 comprise elements similar to those incorporated in the display table and shipping platform apparatus 100, 200, wherein like elements are numbered the same, except preceded by the numerals "3" and "4" respectively. It is further noted that the display table and shipping platform apparatus 300 and display table and shipping platform apparatus 400 are like, simply utilized in a mirrored orientation.

A platform assembly 310 is fabricated comprising a platform section 312. The platform section 312 is defined by a pair of parallel lateral edges and a pair of parallel longitudinal edges, wherein the lateral edges are perpendicular to the longitudinal edges. A leg storage section 320 extends downward from the platform section 312, each leg storage section 320 being parallel to the lateral edge. The leg storage section 320 includes a leg receiving frame 322 having a leg storage channel 324 passing therethrough, the leg receiving frame 322 being either integrated into the platform assembly 310 (as shown), integrated as a unitary construction, or provided as a separate member subsequently attached to the platform section 312. A leg storage end cap 325 can be removably attached to, permanently affixed to, or integrated into the leg storage section 320. Each leg storage section 320 can be reinforced with the inclusion of one or more leg storage reinforcing ribs 360. At least one platform-to-platform attachment interface 330 is provided along an adjoining edge 316 of the platform section 312. An optional platform handle 314 may be formed within or through the platform section 312. The platform assembly 310 can be formed of any material determined to be suitable for the applications. In one exemplary embodiment, the platform assembly 310 is fabricated of a molded fiber reinforced plastic.

Figure 15:
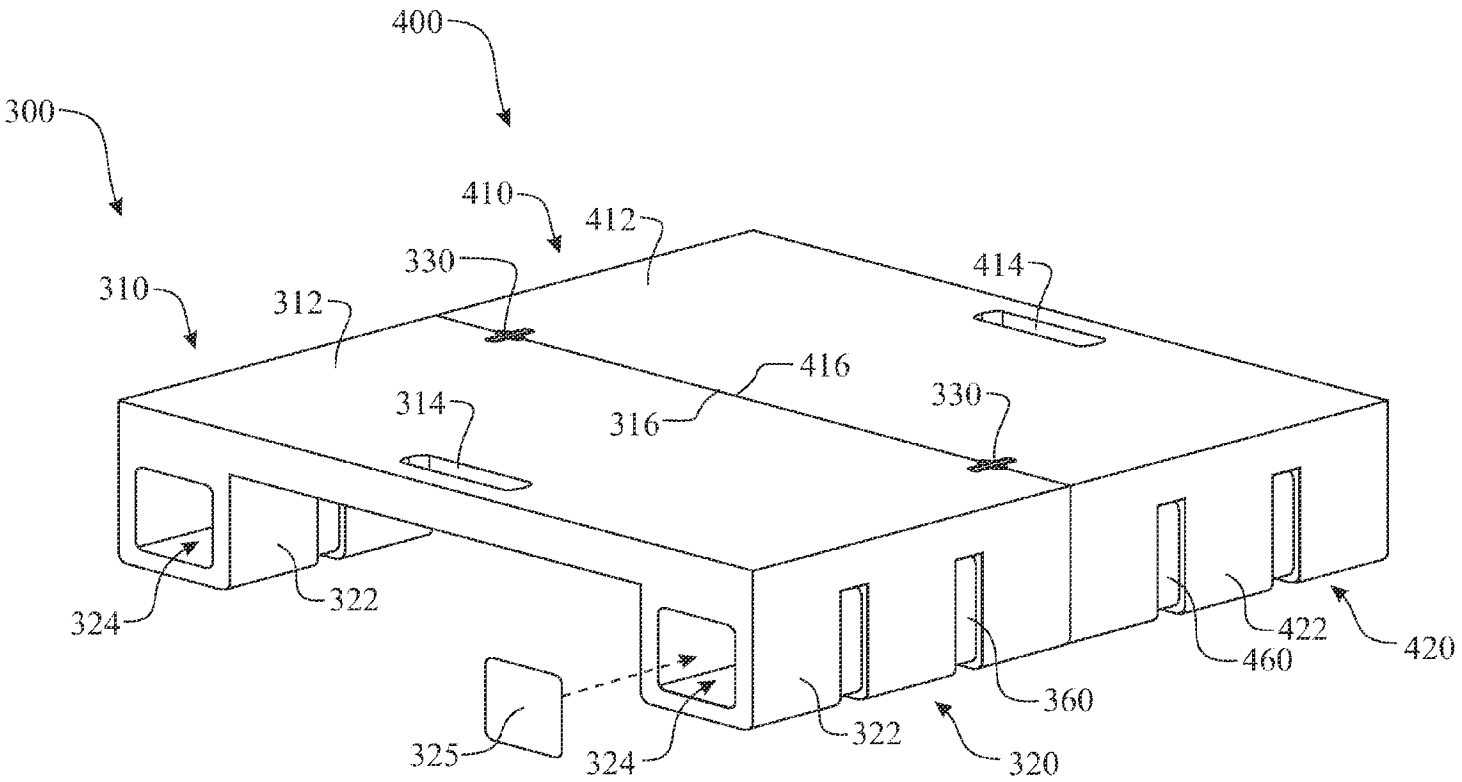
FIG. 15 presents an isometric view of a second exemplary display table and shipping platform apparatus shown in a shipping configuration.
Figure 16:
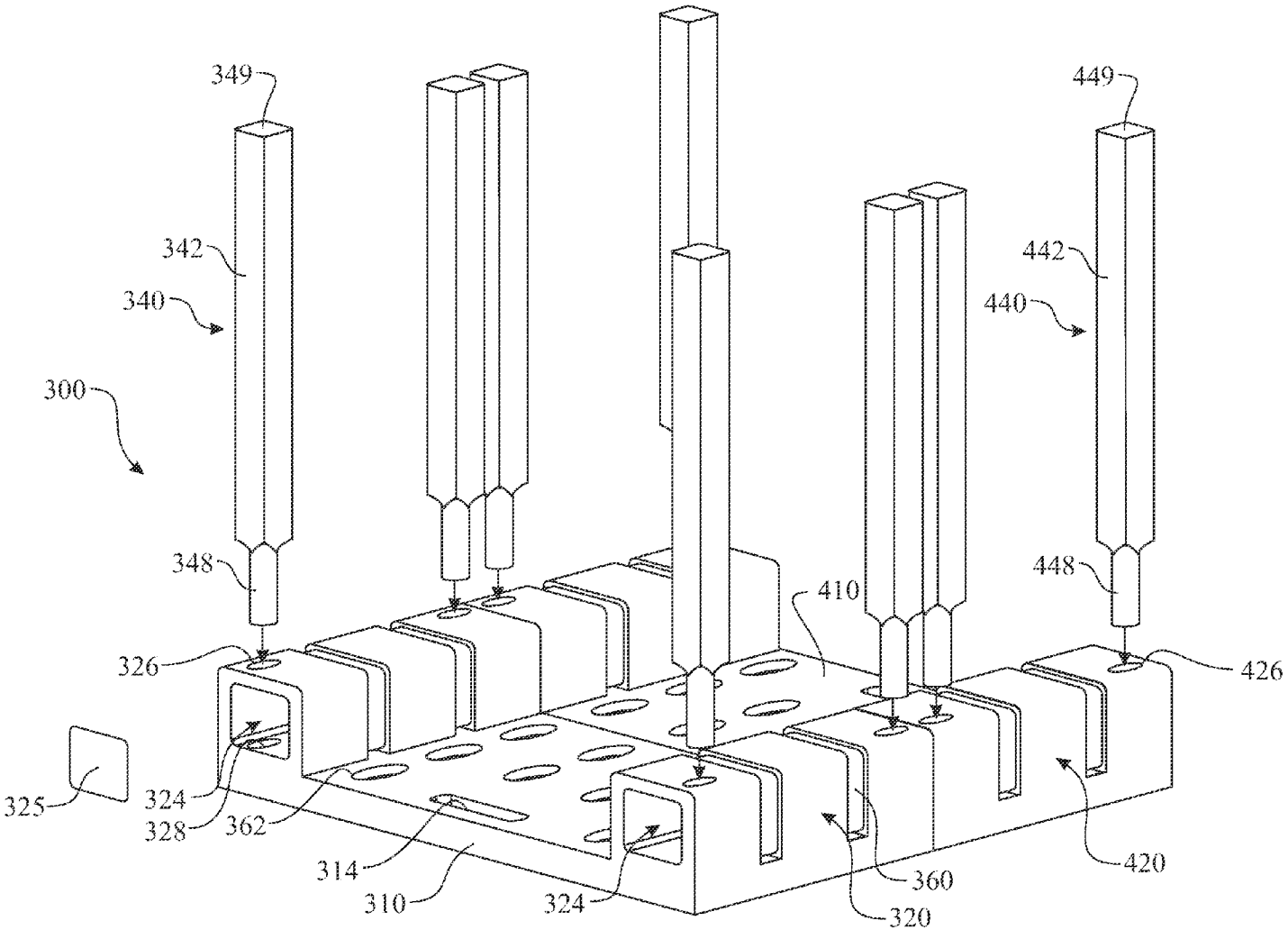
FIG. 16 presents a bottom isometric view of the display table and shipping platform apparatus originally introduced in FIG. 15, shown in an exploded assembly view configuration.
Figure 18:
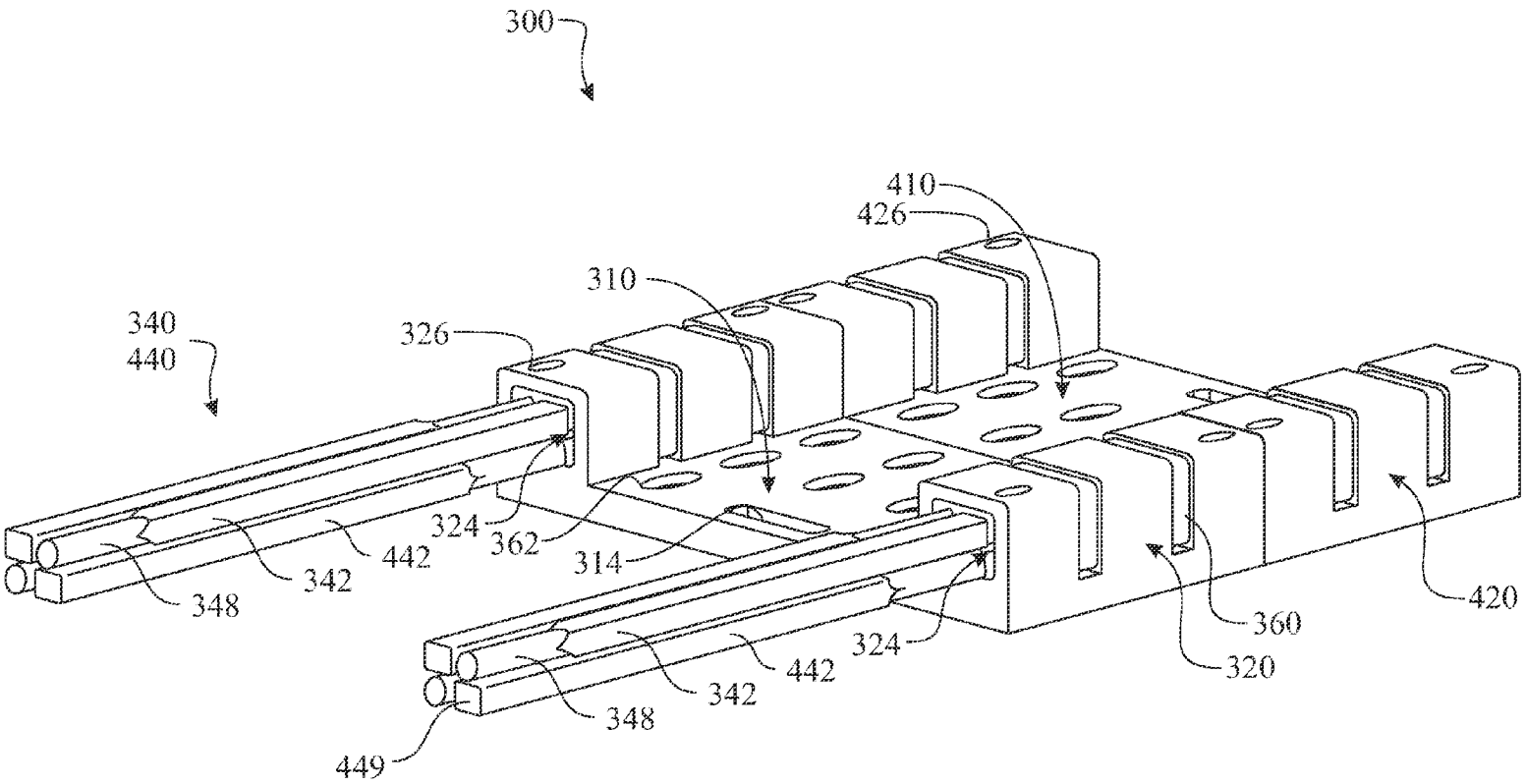
FIG. 18 presents a bottom isometric view of the display table and shipping platform apparatus originally introduced in FIG. 15, shown in an exploded assembly view during a shipping configuration conversion.
Figure 19:
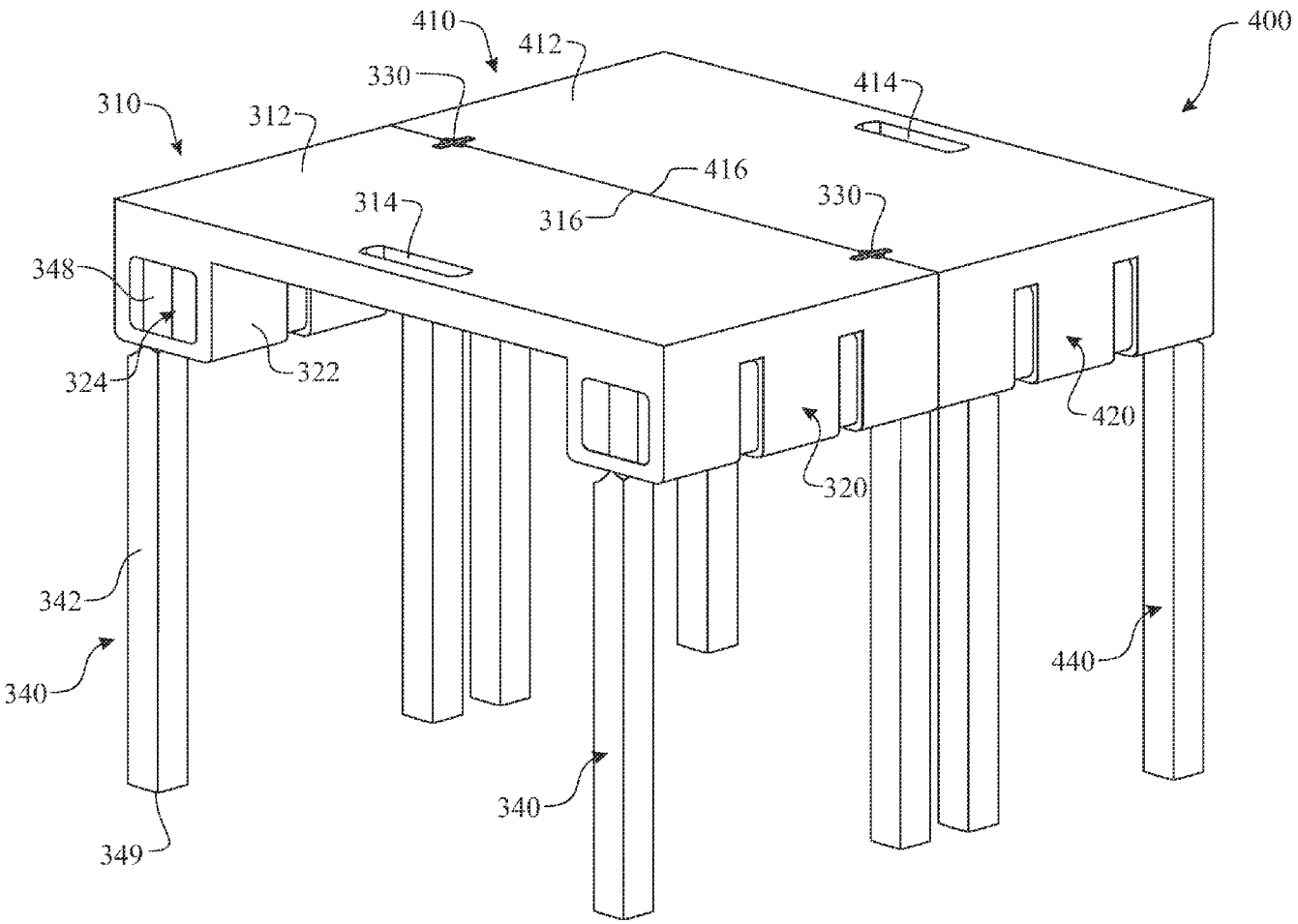
FIG. 19 presents an isometric view of the display table and shipping platform apparatus originally introduced in FIG. 15 shown in a display configuration.

The platform assembly 310, 410 can be configured in either a table configuration (FIG. 19) or a shipping platform configuration (FIGS. 15, 18). The platform assembly 310 and platform assembly 410 are joined by the platform-to-platform attachment interface 330. An exemplary embodiment of the platform-to-platform attachment interface 330 can be similar to the platform-to-platform attachment interface 130 and respective attachment hardware described in FIGS. 12 and 13 above.

The display table and shipping platform apparatus 300 includes a series of leg assemblies 340. The quantity of leg assemblies 340 is determined respective to the design. The leg assemblies 340 are used as legs to support the display table and shipping platform apparatus 300 or combined display table and shipping platform apparatus 300 and display table and shipping platform apparatus 400 configured as a table (FIG. 16, left side of FIG. 17) and as beams to support the combined display table and shipping platform apparatus 300 and display table and shipping platform apparatus 400 configured as a shipping platform (right side of FIG. 17, FIG. 18). Each leg assembly 340 is formed comprising a leg body section 342 having a leg assembly pin 348 extending from a first end and a leg foot 349 defined at an opposite end.

The table configuration requires an interface for assembling the leg assemblies 340 to the platform assembly 310. A plurality of first leg receiving apertures 326 is provided through an exposed lower surface of the leg storage section 320. A respective second leg receiving aperture 328 may be provided for each respective first leg receiving aperture 326. The second leg receiving aperture 328 is formed within an upper portion of the leg storage channel 324. The first leg receiving aperture 326 and respective second leg receiving aperture 328 are sized and shaped to receive the leg assembly pin 348 of the leg assembly 340. In the exemplary embodiment, the second leg receiving aperture 328 can include a leg stop 329. The distal end of the leg assembly pin 348 would seat against the leg stop 329, placing the leg foot 349 equidistant from the platform section 312. This ensures the leg assemblies 340 are vertically positioned equally, placing the leg foot 349 into a co-planar arrangement. The table can include four (4) leg assemblies 340 for each platform assembly 310, 410 (as shown) or four (4) for the combined platform assembly 310 and platform assembly 410, where the leg assemblies 340 would be located at each of the four (4) corners.

Figure 17:
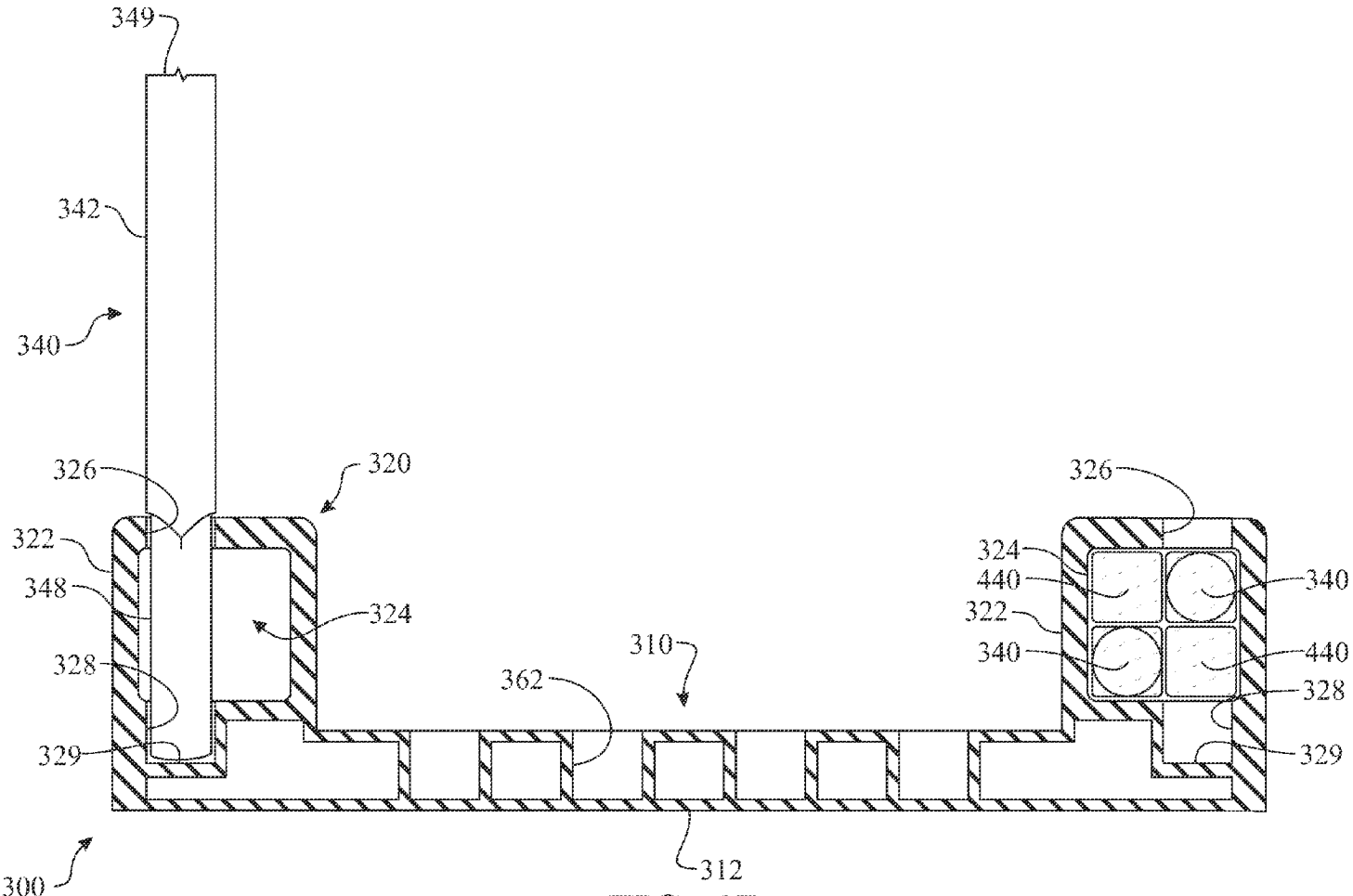
FIG. 17 presents a sectioned side view illustrating one leg inserted into a leg receptacle for a table configuration and four legs inserted into the platform apparatus for a shipment configuration.

The shipping platform configuration requires an interface for utilizing the leg assemblies 340 as a support beam between the combined platform assembly 310 and platform assembly 410. Each leg storage channel 324 would be sized to snuggly receive half of the total number of leg assemblies 340. The leg assemblies 340 form a beam, supporting the platform assembly 310 and platform assembly 410 when assembled together. The leg assemblies 340 are retained within the leg storage channel 324 by a leg storage end cap 325 located at each exterior end thereof. The platform assembly 310 and platform assembly 410 can be joined forming the shipping platform, wherein the leg assemblies 340 are subsequently inserted into and through the leg storage channel 324. The leg assemblies 340 are retained within the leg storage channel 324 by securing one leg storage end cap 325 to each of the openings of each respective leg storage channel 324. In an alternate embodiment, the leg storage end cap 325 is pre-assembled or integrated into the platform assembly 310. The leg assemblies 340 are inserted into the leg storage channel 324 of one of the platform assembly 310, 410. The remaining platform assembly 310, 410 is added to the assembly by sliding the exposed portion of the leg assemblies 340 into the leg storage channel 324 thereof. The platform assembly 310 and platform assembly 410 are brought together and secured using the platform-to-platform attachment interface 330 as described above. It is noted, as illustrated in FIGS. 17 and 18, that the leg assemblies 340 can be inserted in alternating orientations to balance the weight of the shipping platform from side to side.

The platform assembly 310 can include a plurality of platform reinforcing feature 362 extending inward from a bottom surface of the platform section 312, wherein the platform reinforcing feature 362 increase the rigidity across the platform section 312. The platform reinforcing feature 362 can be formed in any shape and dimension to increase the rigidity or stiffness of the platform section 312. It is preferred that the platform reinforcing feature 362 extends inward, but not through the platform section 312 as illustrated in FIG. 17.

A leg assembly 390, introduced in FIG. 20, can be utilized in place of the leg assembly 340. The leg assembly 390 comprises a first leg assembly pin 396 extending from a first end of a leg body section 392 and a second leg assembly pin 398 extending from the opposite end of the leg body section 392, wherein the first leg assembly pin 396, 398 are both sized and shaped to mate with the first leg receiving aperture 326. This enables the user to assembly the display table and shipping platform apparatus 300 in an alternate configuration, as illustrated in FIG. 20. The first leg assembly pin 396 would be inserted into a first leg receiving aperture 326 of a platform assembly 310 used a base member. The second leg assembly pin 398 would be inserted into a first leg receiving aperture 326 of a second platform assembly 310 used as a tabletop member. This configuration provides additional support to the leg assembly 390.

The display table and shipping platform apparatus 300, 400 can be enhanced with the inclusion of several features incorporated into a display table and shipping platform apparatus 500 as illustrated in FIG. 21. The display table and shipping platform apparatus 500 comprise elements similar to those incorporated in the display table and shipping platform apparatus 300, 400, wherein like elements are numbered the same, except preceded by the numeral "5". One or more central support elements 570 can be integrated into a lower portion of the platform assembly 510. The central support element 570 extends downward positioning a central support end 579 to be coplanar between each shipping platform support surface 519 of the leg storage section 520. The central support element 570 provides a central support to the platform assembly 510 when arranged into a shipping platform configuration. Additionally, the central support element 570 stiffens the platform portion 512 spanning between the pair of leg storage sections 520.

Each leg assembly 540 includes a leg assembly pin 548 extending from a leg body section 542 along a central longitudinal axis. An assembly pin transition 547 is provided between the leg body section 542 and the leg assembly pin 548. A leg shoulder receptacle 527 is integrated as a recess extending inward from the shipping platform support surface 519 about each first leg receiving aperture 526. The leg shoulder receptacle 527 is sized and shaped to receive the assembly pin transition 547. It is desired that the cross sectional shape of the assembly pin transition 547 is non-circular, wherein when the assembly pin transition 547 is seated within the leg shoulder receptacle 527, the leg assembly 540 would be refrained from rotating.

Figure 22:
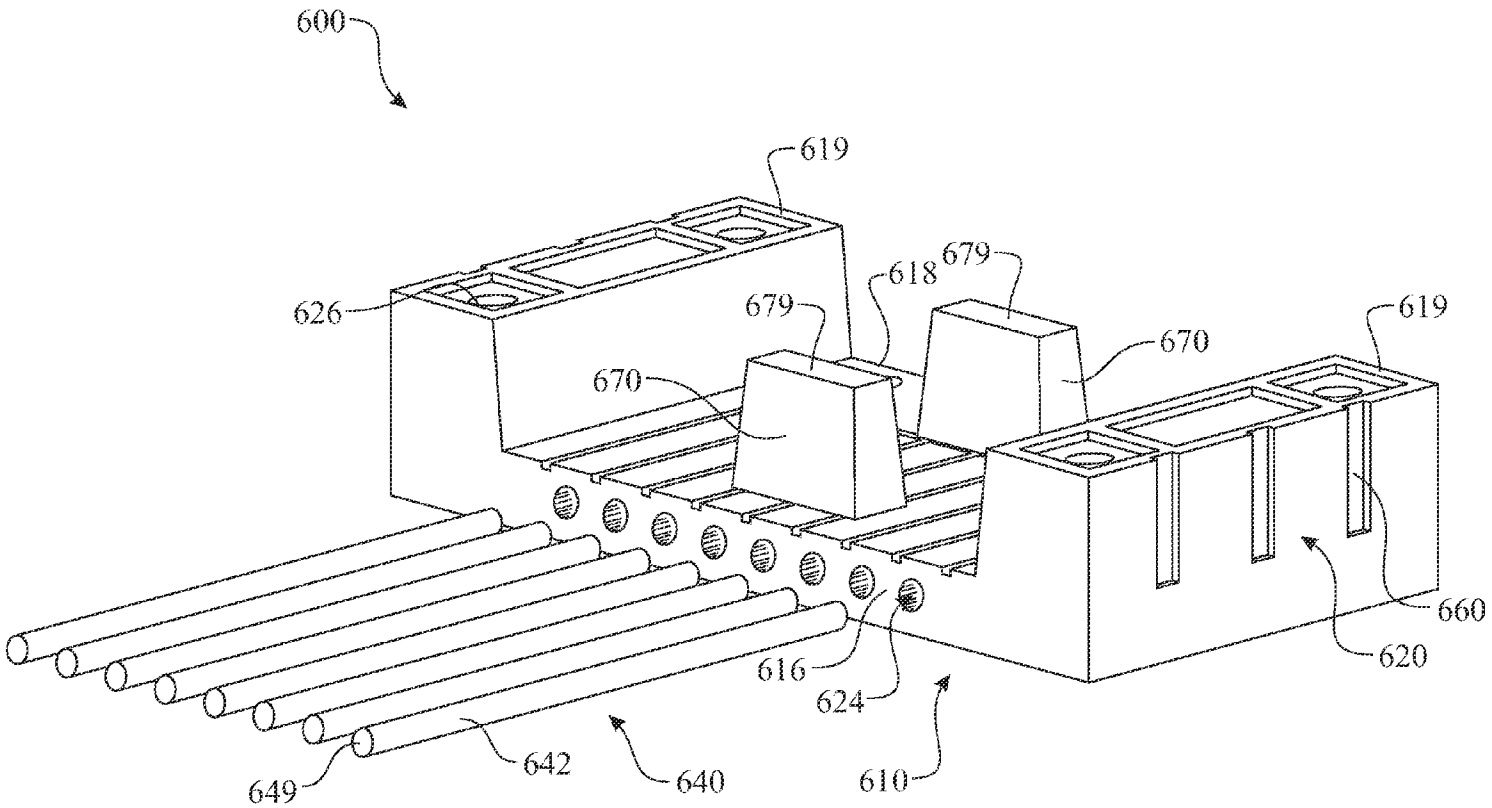
FIG. 22 presents an isometric view of another alternate embodiment of the display table and shipping platform apparatus, wherein the legs are located within cavities through the platform section thereof.
Figure 23:
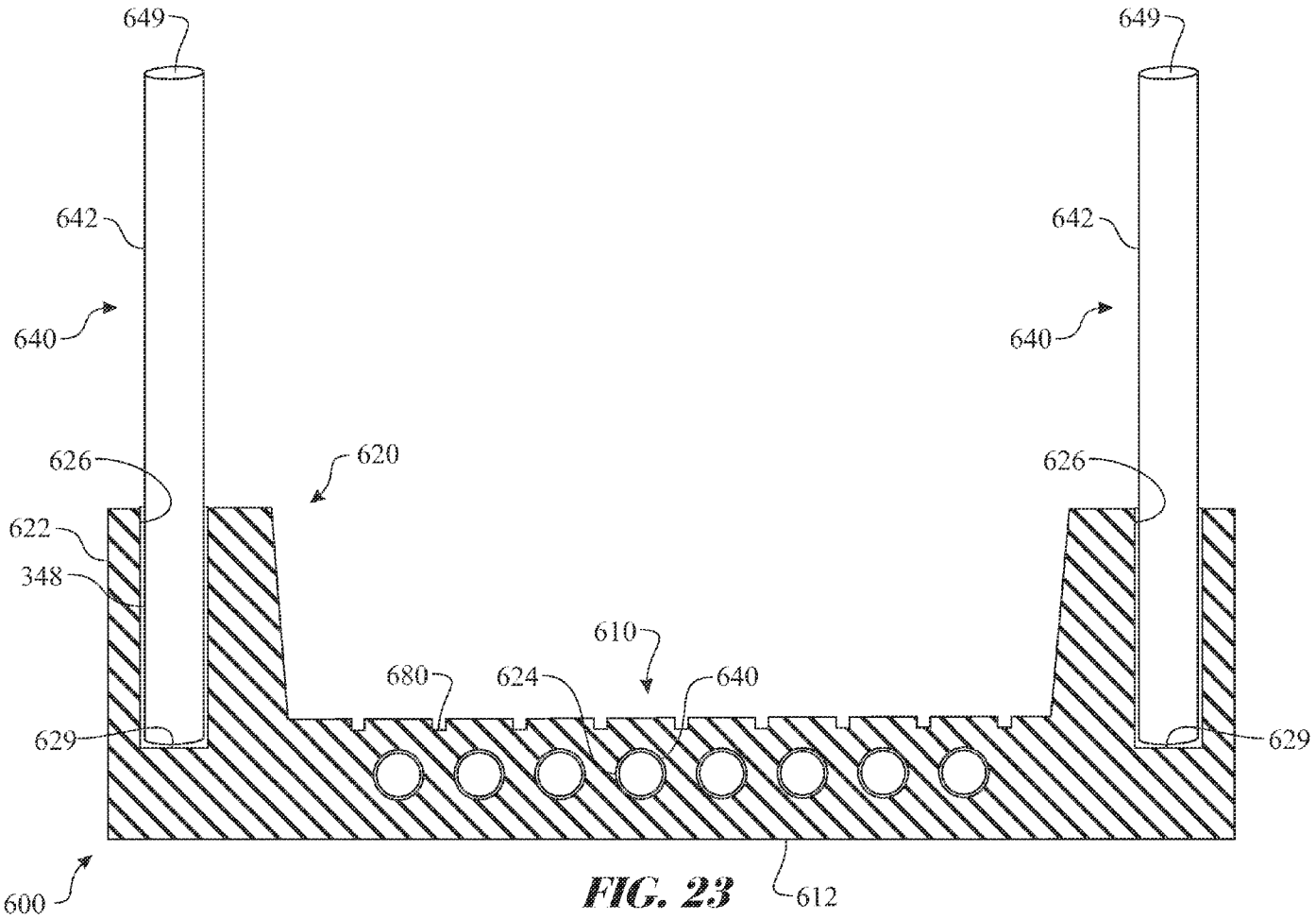
FIG. 23 presents a side section view of the display table and shipping platform apparatus introduced in FIG. 22, wherein the legs are located within cavities through the platform section thereof.
Figure 24:
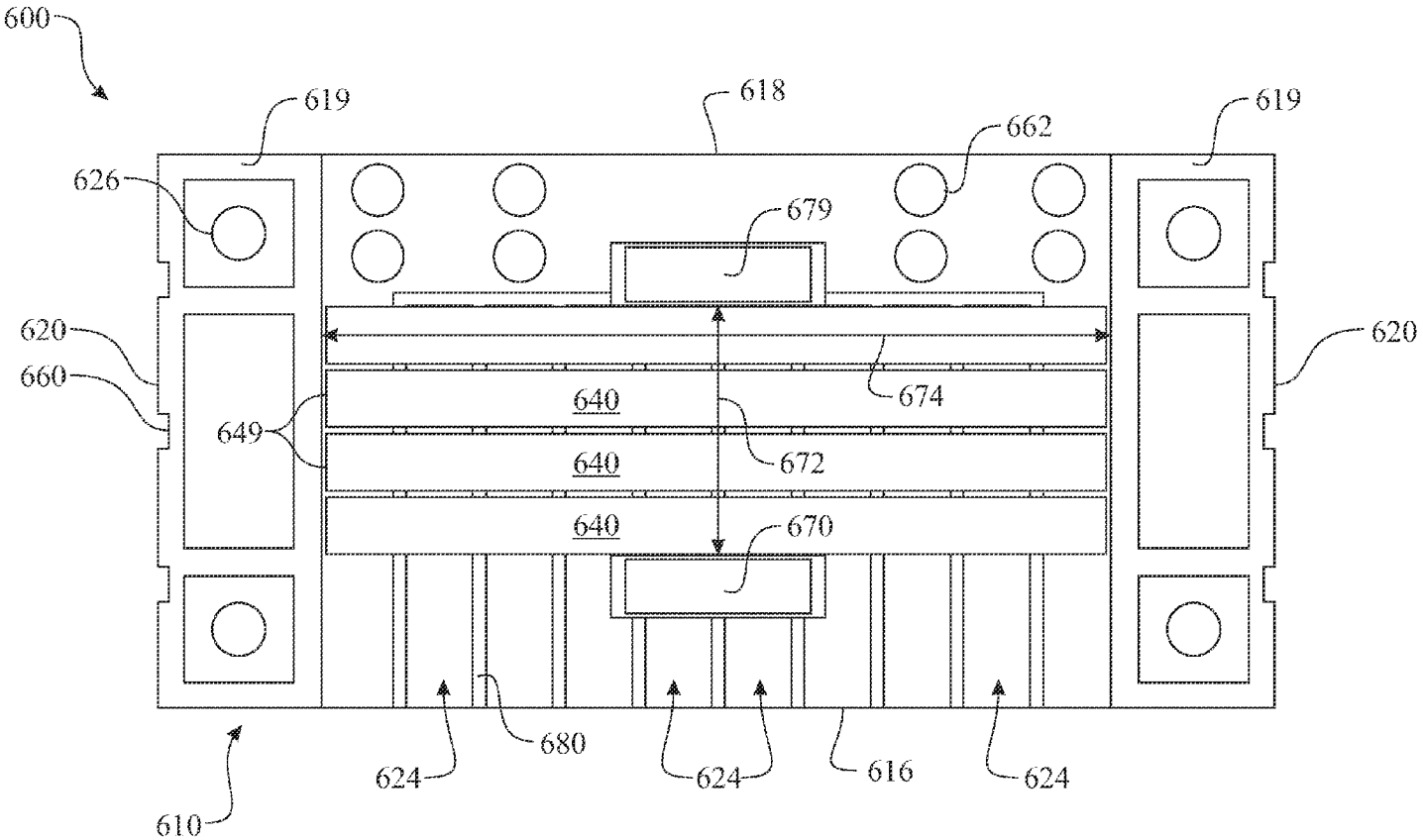
FIG. 24 presents an isometric view of the display table and shipping platform apparatus introduced in FIG. 22, detailing a distribution configuration.
Figure 25:
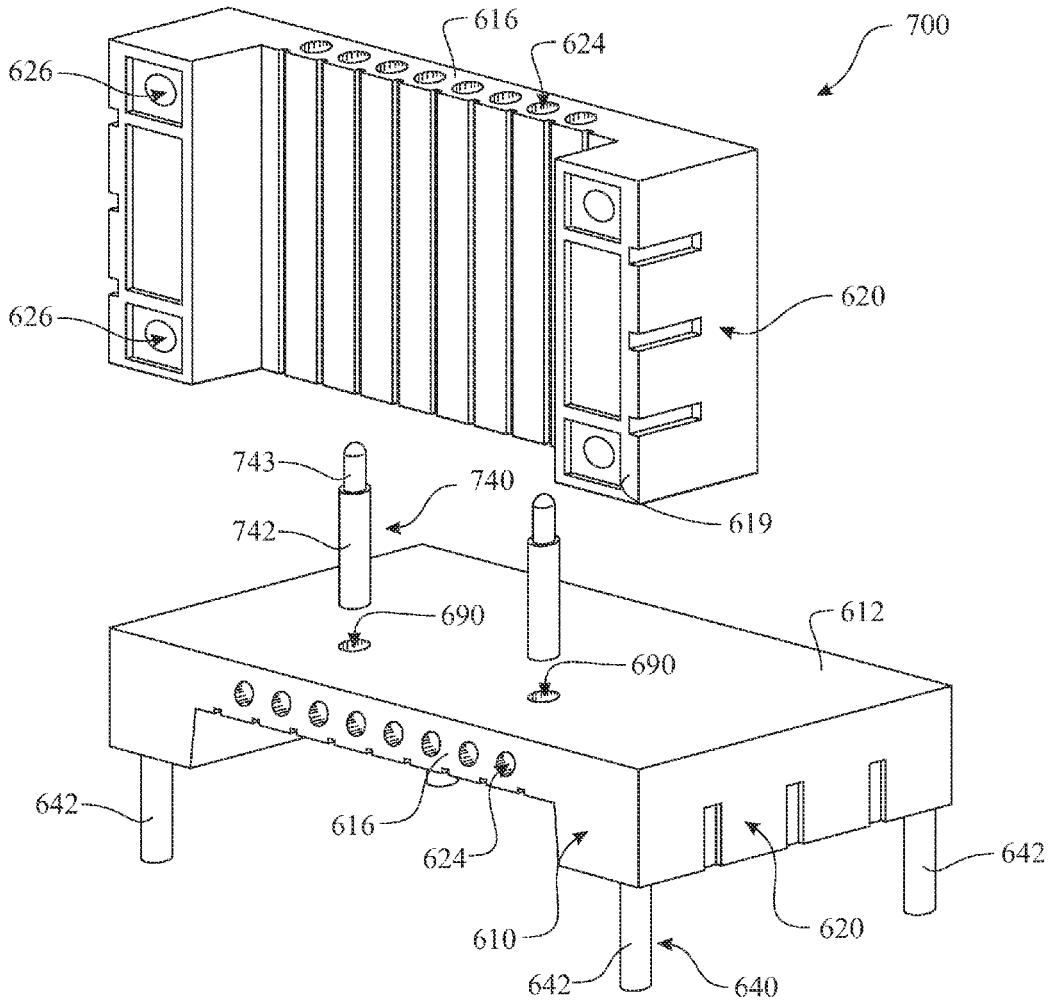
FIG. 25 presents an isometric exploded assembly view of a pair of shipping platforms being configured into a seating bench.
Figure 26:
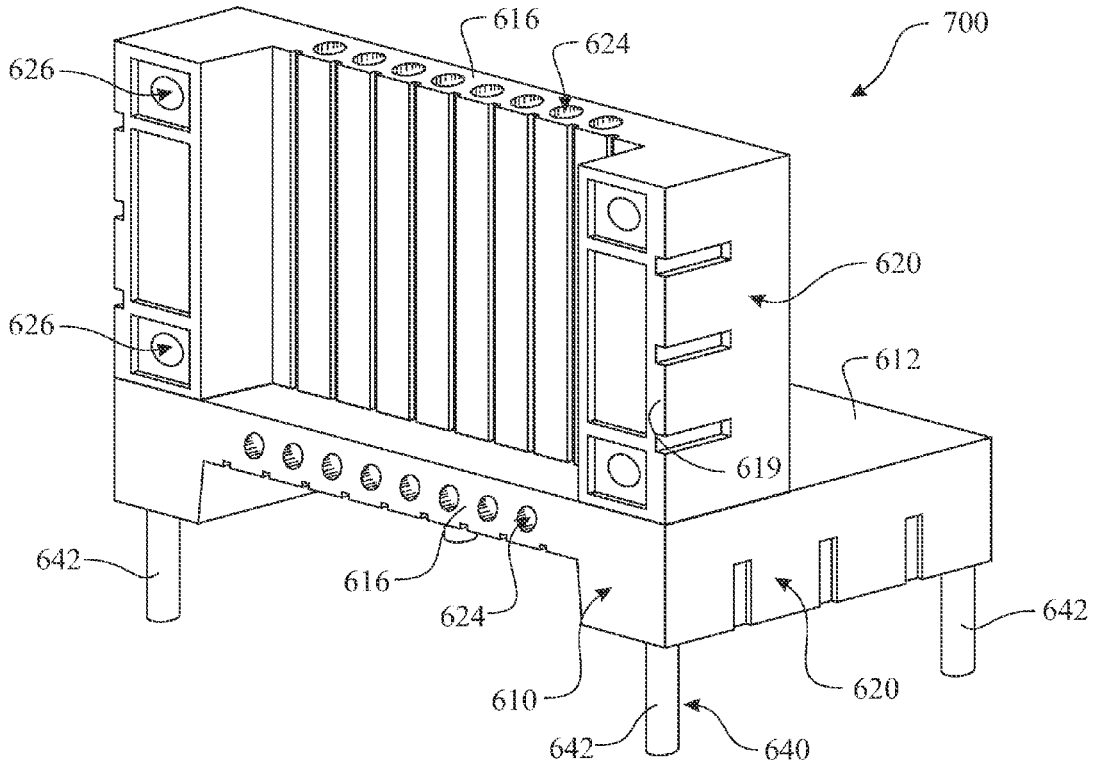
FIG. 26 presents an assembled isometric view of the pair of shipping platforms configured into the seating bench.
Figure 27:
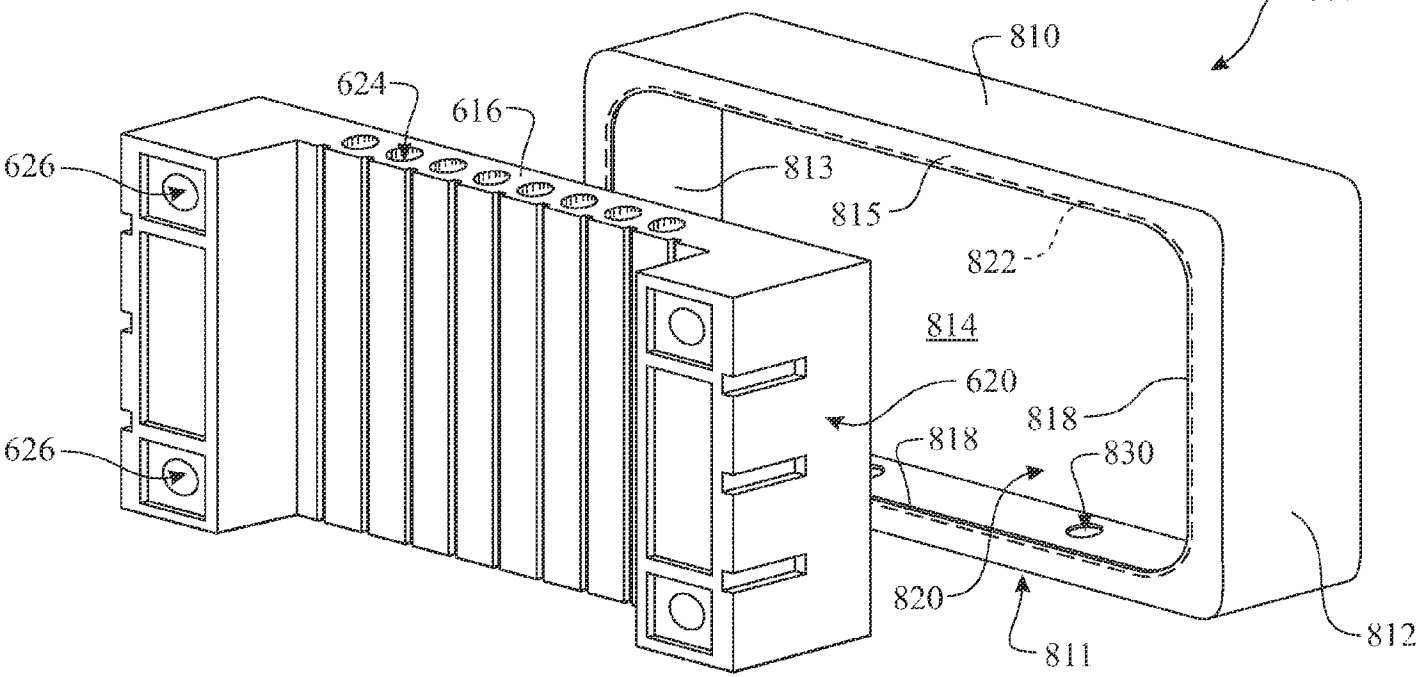
FIG. 27 presents an isometric exploded assembly view of an exemplary platform cover for placement over the platform assembly.

The display table and shipping platform apparatus 300, 400, 500 can be modified positioning a plurality of leg storage channels 624 through a platform assembly 610 portion of a display table and shipping platform apparatus 600 as illustrated in FIGS. 21 through 23. The display table and shipping platform apparatus 600 comprise elements similar to those incorporated in the display table and shipping platform apparatus 300, 400, 500 wherein like elements are numbered the same, except preceded by the numeral "6".

The plurality of leg storage channels 624 is formed to individually receive a respective leg assembly 640 as illustrated in FIGS. 21 and 22. Each of the leg assemblies 640 is formed by boring a channel through a mating edge 616, extending into a central portion of the platform section 612. A channel defining slots 680 can outline each leg storage channel 624. The channel defining slots 680 is included during a molding process used to form a platform support section 620. Each leg storage channel 624 would be equally spaced and parallel to a surface of the platform section 612. Each of the platform support extension 622 can be either solid or hollow and supported via a framing. A leg receiving aperture 626 would be either molded into or formed using a drilling, boring or similar process; the leg receiving aperture 626 terminating at a leg stop 629. The leg receiving aperture 626 would be sized and shaped to receive a portion of the leg assembly 640, as illustrated in FIG. 23. Each leg assembly 640 is inserted into a respective leg receiving aperture 626 configuring the display table and shipping platform apparatus 600 into a table. The display table and shipping platform apparatus 600 is converted into a shipping platform by inserting each leg assembly 640 into a respective leg storage channel 624 of a first platform assembly 610, then sliding a second platform assembly 610 onto the assembly while inserting the exposed portion of each leg assembly 640 into a leg storage channel 624 of the second platform assembly 610.

Each receptacle 624, 626 is preferably sized to snugly receive and retain a mating portion of the leg assembly 640. The receptacles 624, 626 have a depth that is approximately ½ of the total length of the leg assembly 640. In the exemplary embodiment, each leg assembly 640 is cylindrically shaped. The cylindrical shape enables fabrication of the receptacles 624, 626 using a simple machining process, such as drilling, boring, and the like. Alternately, a circular receptacle simplifies the design and fabrication of a mold. A series of channel defining slots 680 is formed during the molding process. The channel defining slots 680 can be used to reference the location of each of the leg storage channels 624. It is understood that the leg storage channel 624 can be sized and shaped to receive multiple leg assemblies 640 if desired.

The display table and shipping platform apparatus 600 includes a pair of central support element 670, which provides several functions:

a) Increasing the rigidity of the platform assembly 610 across the platform span section, b) Supporting the platform span section when placed in a shipping configuration, (the platform section 612 and central support end 679 are coplanar and contact the ground, thus supporting the span), and c) Retain the leg assemblies 640 when placed therebetween for initial shipping and delivery from the manufacture to the end user.

A transverse span 672 is provided between the pair of central support elements 670, wherein the transverse span 672 is consistent with a multiple of the total quantity of leg assemblies 640 provided with the display table and shipping platform apparatus 600. A longitudinal span 674 is provided between the pair of platform support sections 620, wherein the longitudinal span 674 is consistent with a length of the leg assemblies 640. The leg assemblies 640 are positioned with an area defined by the transverse span 672 and longitudinal span 674 for initial shipping and delivery from the manufacture to the end user.

With a slight modification, the pair of platform sections 620 can be configured into a bench configuration 700. A first platform support section 620 would be oriented horizontally and configured having four (4) leg assemblies 640 extending downward (as previously described) and a second platform support section 620 would be rotated into a generally vertical orientation and assembled to the first platform support section 620 forming an upward bench back. The modification introduces at least two (2) chair back support apertures 690 through an upper surface of a platform section 612. Each of the chair back support apertures 690 are sized and shaped to receive a leg assembly 740. Each of the at least two (2) chair back support apertures 690 would be located to align with a respective leg storage channel 624 of a second platform support section 620. Each leg assembly 740 is similar to the leg assembly 640 (as previously described) while being shaped comprising a reduced diameter leg body segment 743 extending axially from a primary leg body segment 742. A first leg assembly 740 is inserted into one chair back support aperture 690 and a second leg assembly 740 is inserted into a second chair back support aperture 690. The second platform support section 620 is assembled to the first support section 620 by aligning each of the reduced diameter leg body segment 743 of the respective leg assemblies 740 with a respective leg storage channel 624 of the second platform support section 620. The registration between the chair back support apertures 690 and the associated leg storage channels 624 aligns the outer edges of the second platform support section 620 with the outer edges of the first platform support section 620 and, preferably, a bottom surface 619 of the second platform support section 620 with a respective mating edge 616 of the first platform support section 620. The second platform support section 620 is lowered to a position where a contacting mating edge 616 is resting against the platform section or upper surface 612. The platform support section 620 can be perpendicular to the platform section or upper surface 612 or angled slightly rearward by providing the chair back support aperture 690 at a desired angle. The bench configuration 700 can be dressed or aesthetically enhanced by covering the first platform support section 620, the second platform support section 620 or preferably both the first and second platform support sections 620 with a platform cover 800. The platform cover 800 can be fabricated of any suitable material, including cloth, leather, vinyl, velvet, flexible plastic, and the like. The platform cover 800 can be manufactured by stitching the material into a shape resembling the shape of each platform support section 620, including a top panel or segment 810, a bottom panel or segment 811, a first side panel or segment 812, a second side panel or segment 813, a front panel or segment 814, and a rear panel or segment 815. Collectively, the panels 810, 811, 812, 813, 814, 815 define an interior cavity 820. The rear panel 815 includes an opening defined by a peripheral edge 818. The opening provides access to the interior cavity 820. A tightening element 822 can be assembled to a peripheral edge 818 of the platform cover 800. The tightening element 822 can be a cording, elastic, buttons, dense hook and loop tape, and the like, where the tightening element 822 retains the cover on the platform support section 620. Alternatively, at least a portion of the peripheral edge 818 of the platform cover 800 can be secured to the platform support section 620 using any suitable mechanical fastener, including dense hook and loop tape, snaps, hooks attached to an elastic strap, and the like. A series of assembly apertures 830 can be formed for passing each of the leg assemblies 740 through a respective panel, such as the bottom panel or segment 811. The apertures can be reinforced by stitching, a bonded material, and the like. The platform cover 800 can be designed to cover one platform support section 620, a pair of 620, and the like. The platform cover 800 can be used for the bench configuration, table configuration or any other suitable application.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A method of converting an apparatus between a shipping platform and a table, the method comprising steps of:

obtaining a first platform assembly, a second platform assembly and a plurality of leg subassemblies;

each platform assembly having a group of elements, said group of elements of said apparatus comprising:

a platform section having a platform upper surface, a platform lower surface, a mating edge, a distal edge located opposite said mating edge, a pair of lateral edges extending perpendicular between said mating edge and said distal edge, and a thickness, a pair of platform support sections, each platform support section extending downward from an underside of each platform proximate said respective lateral edge, and at least one leg storage channel, each at least one leg storage channel extending into each of said platform sections from said mating edge;

each leg subassembly comprising:

an assembly interface segment extending from an end of a leg body segment, wherein each of said at least one leg storage channel is formed for receiving and storing said leg subassemblies therein in a manner whereby said leg subassemblies provide support to said first platform assembly and second platform assembly in a shipping configuration;

determining a first desired assembly configuration to be one of the shipping platform configuration and a table configuration;

assembling said group of elements of said apparatus into the shipping platform configuration when said desired assembly configuration is said shipping platform configuration by:

inserting said plurality of leg subassemblies into said at least one leg storage channel of said first platform assembly, assembling said second platform assembly by sliding said plurality of leg subassemblies into said at least one leg storage channel of said second platform assembly, and securing said first platform assembly and said second platform assembly to one another; and assembling said group of elements of said apparatus into said table configuration when said desired assembly configuration is said table configuration by:

assembling each of said plurality of leg subassemblies to at least one of said first platform assembly and said second platform assembly in a manner where each of said plurality of leg subassemblies extends generally downward therefrom in a manner to support said platform assembly as said table; and reconfiguring said apparatus for said first desired assembly configuration to a second desired assembly configuration, wherein said second desired assembly configuration is a configuration not selected in said initial determination step by:

dismantling said apparatus from said first desired assembly configuration, and assembling said group of elements of said apparatus in accordance with a respective assembly procedure of said second desired assembly configuration.

2. A method of converting an apparatus between a shipping platform and a display table as recited in claim 1, the method comprising additional steps of:

assembling two table configurations, one utilizing said first platform assembly and a second utilizing said second platform assembly; and securing said first platform assembly and said second platform assembly to one another.

3. A method of converting an apparatus between a shipping platform and a display table as recited in claim 1, wherein said step of securing said first platform assembly and said second platform assembly to one another is accomplished by inserting a first free end of a "U" shaped securing pin through an aperture provided through said first platform assembly and a second free end of said "U" shaped securing pin through an aperture provided through said second platform assembly.

4. A method of converting an apparatus between a shipping platform and a display table as recited in claim 1, wherein said step of assembling each of said plurality of leg subassemblies to at least one of said first platform assembly and said second platform assembly forming said table configuration is accomplished by inserting said assembly interface segment extending into a respective interior leg receiving aperture provided in said respective platform assembly.

5. A method of converting an apparatus between a shipping platform and a display table as recited in claim 1, wherein said step of assembling said plurality of leg subassemblies between said first platform assembly and said second platform assembly forming said shipping platform configuration is accomplished by inserting an individual leg assembly of said plurality of leg subassemblies into said respective leg storage channel.

6. A method of converting an apparatus between a shipping platform and a display table as recited in claim 1, wherein said step of assembling said plurality of leg subassemblies between said first platform assembly and said second platform assembly forming said shipping platform configuration is accomplished by inserting more than one leg assembly of said plurality of leg subassemblies into said respective leg storage channel.

7. A method of converting an apparatus between a shipping platform and a display table as recited in claim 1, further comprising steps of:

assembling said group of elements of said apparatus into said shipping platform configuration;

placing objects onto said apparatus arranged in said shipping platform configuration;

shipping said apparatus arranged in said shipping platform configuration and supported objects to an event;

removing said objects from said apparatus arranged in said shipping platform configuration;

dismantling said apparatus arranged in said shipping platform configuration;

assembling said group of elements of said apparatus into said table configuration.

8. A method of converting an apparatus between a shipping platform and a bench, the method comprising steps of:

obtaining a first platform assembly, a second platform assembly and a plurality of leg subassemblies;

each platform assembly having a group of elements, said group of elements of said apparatus comprising:

a platform section having a platform upper surface, a platform lower surface, a mating edge, a distal edge located opposite said mating edge, a pair of lateral edges extending perpendicular between said mating edge and said distal edge, and a thickness, a pair of platform support sections, each platform support section extending downward from an underside of each platform proximate said respective lateral edge, and at least one leg storage channel, each at least one leg storage channel extending into each of said platform sections from said mating edge;

each leg subassembly comprising:

an assembly interface segment extending from an end of a leg body segment, wherein each of said at least one leg storage channel is formed for receiving and storing said leg subassemblies therein in a manner whereby said leg subassemblies provide support to said first platform assembly and second platform assembly in a shipping configuration;

determining a first desired assembly configuration to be one of a shipping platform configuration and a bench configuration;

assembling said group of elements of said apparatus into the shipping platform configuration when said desired assembly configuration is the shipping platform configuration by:

inserting said plurality of leg subassemblies into said at least one leg storage channel of said first platform assembly, assembling said second platform assembly by sliding said plurality of leg subassemblies into said at least one leg storage channel of said second platform assembly, and securing said first platform assembly and said second platform assembly to one another; and assembling said group of elements of said apparatus into said bench configuration when said desired assembly configuration is said bench configuration by:

assembling each of said plurality of leg subassemblies to said first platform assembly in a manner where each of said plurality of leg subassemblies extends generally downward therefrom in a manner to support said platform assembly as a seat of said bench, and assembling said second platform assembly in a vertical orientation to said first platform assembly forming said bench configuration; and reconfiguring said apparatus for said first desired assembly configuration to a second desired assembly configuration, wherein said second desired assembly configuration is a configuration not selected in said initial determination step by:

dismantling said apparatus from said first desired assembly configuration, and assembling said group of elements of said apparatus in accordance with a respective assembly procedure of said second desired assembly configuration.

9. A method of converting an apparatus between a shipping platform and a bench as recited in claim 8, the method comprising additional steps of:

placing a cover over at least one of said first platform assembly and said second platform assembly.

10. A method of converting an apparatus between a shipping platform and a bench as recited in claim 8, wherein said step of securing said first platform assembly and said second platform assembly to one another is accomplished by inserting a first free end of a "U" shaped securing pin through an aperture provided through said first platform assembly and a second free end of said "U" shaped securing pin through an aperture provided through said second platform assembly.

11. A method of converting an apparatus between a shipping platform and a bench as recited in claim 8, wherein said step of assembling each of said plurality of leg subassemblies to at least one of said first platform assembly and said second platform assembly forming said table configuration is accomplished by inserting said assembly interface segment extending into a respective interior leg receiving aperture provided in said respective platform assembly.

12. A method of converting an apparatus between a shipping platform and a bench as recited in claim 8, wherein said step of assembling said plurality of leg subassemblies between said first platform assembly and said second platform assembly forming said shipping platform configuration is accomplished by inserting an individual leg assembly of said plurality of leg subassemblies into said respective leg storage channel.

13. A method of converting an apparatus between a shipping platform and a bench as recited in claim 8, wherein said step of assembling said plurality of leg subassemblies between said first platform assembly and said second platform assembly forming said shipping platform configuration is accomplished by inserting more than one leg assembly of said plurality of leg subassemblies into said respective leg storage channel.

14. A method of converting an apparatus between a shipping platform and a bench as recited in claim 8, further comprising steps of:

assembling said group of elements of said apparatus into said shipping platform configuration;

placing objects onto said apparatus arranged in said shipping platform configuration;

shipping said apparatus arranged in said shipping platform configuration and supported objects to an event;

removing said objects from said apparatus arranged in said shipping platform configuration;

dismantling said apparatus arranged in said shipping platform configuration;

assembling said group of elements of said apparatus into said bench configuration.

15. A method of converting an apparatus between a shipping platform, a table, and a bench, the method comprising steps of:

obtaining a first platform assembly, a second platform assembly and a plurality of leg subassemblies;

each platform assembly having a group of elements, said group of elements of said apparatus comprising:

a platform section having a platform upper surface, a platform lower surface, a mating edge, a distal edge located opposite said mating edge, a pair of lateral edges extending perpendicular between said mating edge and said distal edge, and a thickness, a pair of platform support sections, each platform support section extending downward from an underside of each platform proximate said respective lateral edge, and at least one leg storage channel, each at least one leg storage channel extending into each of said platform sections from said mating edge;

each leg subassembly comprising:

an assembly interface segment extending from an end of a leg body segment, wherein each of said at least one leg storage channel is formed for receiving and storing said leg subassemblies therein in a manner whereby said leg subassemblies provide support to said first platform assembly and second platform assembly in a shipping configuration;

determining a first desired assembly configuration to be one of a shipping platform configuration, a table configuration, and a bench configuration;

assembling said group of elements of said apparatus into the shipping platform configuration when said desired assembly configuration is the shipping platform configuration by:

inserting said plurality of leg subassemblies into said at least one leg storage channel of said first platform assembly, assembling said second platform assembly by sliding said plurality of leg subassemblies into said at least one leg storage channel of said second platform assembly, and securing said first platform assembly and said second platform assembly to one another; and assembling said group of elements of said apparatus into said table configuration when said desired assembly configuration is said table configuration by:

assembling each of said plurality of leg subassemblies to at least one of said first platform assembly and said second platform assembly in a manner where each of said plurality of leg subassemblies extends generally downward therefrom in a manner to support said platform assembly as said table;

assembling said group of elements of said apparatus into said bench configuration when said desired assembly configuration is said bench configuration by:

assembling each of said plurality of leg subassemblies to said first platform assembly in a manner where each of said plurality of leg subassemblies extends generally downward therefrom in a manner to support said platform assembly as a seat of said bench, and assembling said second platform assembly in a vertical orientation to said first platform assembly forming said bench configuration; and reconfiguring said apparatus for said first desired assembly configuration to a second desired assembly configuration, wherein said second desired assembly configuration is a configuration not selected in said initial determination step by:

dismantling said apparatus from said first desired assembly configuration, and assembling said group of elements of said apparatus in accordance with a respective assembly procedure of said second desired assembly configuration.

16. A method of converting an apparatus between a shipping platform and a bench as recited in claim 15, further comprising a step of:

reconfiguring said apparatus for said second desired assembly configuration to a third desired assembly configuration, wherein said third desired assembly configuration is a configuration that differs from said first desired assembly configuration and said second desired assembly configuration by:

dismantling said apparatus from said second desired assembly configuration, and assembling said group of elements of said apparatus in accordance with a respective assembly procedure of said third desired assembly configuration.

17. A method of converting an apparatus between a shipping platform and a bench as recited in claim 15, wherein said step of assembling each of said plurality of leg subassemblies to at least one of said first platform assembly and said second platform assembly forming said table configuration is accomplished by inserting said assembly interface segment extending into a respective interior leg receiving aperture provided in said respective platform assembly.

18. A method of converting an apparatus between a shipping platform and a bench as recited in claim 15, wherein said step of assembling said plurality of leg subassemblies between said first platform assembly and said second platform assembly forming said shipping platform configuration is accomplished by inserting a individual leg assembly of said plurality of leg subassemblies into said respective leg storage channel.

19. A method of converting an apparatus between a shipping platform and a bench as recited in claim 15, wherein said step of assembling said plurality of leg subassemblies between said first platform assembly and said second platform assembly forming said shipping platform configuration is accomplished by inserting more than one leg assembly of said plurality of leg subassemblies into said respective leg storage channel.

20. A method of converting an apparatus between a shipping platform and a bench as recited in claim 15, further comprising steps of:

assembling said group of elements of said apparatus into said shipping platform configuration;

placing objects onto said apparatus arranged in said chipping platform configuration;

shipping said apparatus arranged in said shipping platform configuration and supported objects to an event;

removing said objects from said apparatus arranged in said shipping platform configuration;

dismantling said apparatus arranged in said shipping platform configuration;

assembling said group of elements of said apparatus into one of said bench configuration and said table configuration.

* * * * *